US008752410B2

(12) United States Patent
Rogers et al.

(10) Patent No.: US 8,752,410 B2
(45) Date of Patent: Jun. 17, 2014

(54) TOOLING ASSEMBLIES AND SYSTEMS

(75) Inventors: Bryan L. Rogers, Forest Lake, MN (US); Brian J. Lee, Elk River, MN (US)

(73) Assignee: Wilson Tool International Inc., White Bear Lake, MN (US)

( * ) Notice: Subject to any disclaimer, the term of this patent is extended or adjusted under 35 U.S.C. 154(b) by 221 days.

(21) Appl. No.: 13/189,503

(22) Filed: Jul. 23, 2011

(65) Prior Publication Data

US 2013/0019650 A1 Jan. 24, 2013

(51) Int. Cl.
*B21D 5/02* (2006.01)
*B21D 37/04* (2006.01)

(52) U.S. Cl.
CPC ..... *B21D 5/0209* (2013.01); *B21D 5/0236* (2013.01)
USPC ..... 72/413; 72/481.1; 72/481.6; 72/482.1; 72/482.92; 76/107.1

(58) Field of Classification Search
USPC ..... 72/413, 462, 481.1, 481.2, 481.6, 72/482.1, 482.2, 482.92, 482.93; 76/107.1
See application file for complete search history.

(56) References Cited

U.S. PATENT DOCUMENTS

| | | | | |
|---|---|---|---|---|
| 1,809,823 | A | 6/1931 | Altvater | |
| 2,105,391 | A * | 1/1938 | Almdale | 72/482.91 |
| 2,152,072 | A | 3/1939 | Maute | |
| 4,790,888 | A | 12/1988 | Bessey | |
| 5,113,686 | A * | 5/1992 | Kawahara | 72/462 |
| 6,467,327 | B1 | 10/2002 | Runk | |
| 6,516,649 | B1 | 2/2003 | Mika | |
| 6,644,091 | B2 * | 11/2003 | Huang et al. | 72/482.93 |
| 7,021,116 | B2 | 4/2006 | Harrington | |
| 7,069,765 | B2 * | 7/2006 | Grove et al. | 72/481.1 |
| 7,168,286 | B1 * | 1/2007 | Pelech | 72/482.92 |
| 7,401,491 | B2 * | 7/2008 | Leland | 72/413 |
| 7,596,983 | B2 | 10/2009 | Pabich | |
| 7,661,288 | B2 * | 2/2010 | Shimota et al. | 72/482.1 |
| 7,721,586 | B2 | 5/2010 | Pabich | |
| 2008/0083259 | A1 * | 4/2008 | Mazzocchi | 72/481.1 |

FOREIGN PATENT DOCUMENTS

| | | |
|---|---|---|
| DE | 2608159 | 9/1977 |
| FR | 2598946 | 11/1987 |
| IT | AN20080019 U1 | 3/2010 |

OTHER PUBLICATIONS

International Search Report and Written Opinion for International Application No. PCT/US2012/045747, dated Sep. 14, 2012, 11 pages.
Angelo Romani product brochure for Sheet Networking—Easy Tooling, 6 pages.

* cited by examiner

*Primary Examiner* — David B Jones
(74) *Attorney, Agent, or Firm* — Fredrikson & Byron, P.A.

(57) ABSTRACT

Press tool assemblies involve separable holder and tip portions. Self-seating structure is incorporated in these assemblies, and can stem from one or both of the separable portions of the assemblies. In use, the self-seating structure facilitates proper positioning and seating of the separable portions in relation to each other, and in some cases, can be used in operatively coupling the portions together. Advantages relating to assembly and disassembly of the tool assemblies, as well as improved structural properties result as a consequence of using the self-seating structure.

36 Claims, 15 Drawing Sheets

TOOLING ASSEMBLIES AND SYSTEMS

FIELD OF INVENTION

The present invention relates generally to industrial presses. More particularly, this invention relates to tooling assemblies for such presses.

BACKGROUND

A variety of industrial presses are known in the art. One such press is the press brake. Press brakes are commonly used to bend or otherwise deform sheet-like workpieces, such as sheet metal workpieces. A conventional press brake has an upper beam and a lower beam, at least one of which is movable toward and away from the other. Typically, the upper beam is movable vertically while the lower beam is fixed in a stationary position. It is common for tooling (e.g., a male forming punch and a female forming die) to be separately mounted on the press brake upper and lower beams. For example, in some cases, the punch is to be mounted on the press upper beam, while the female forming die is to be mounted on the press lower beam.

Typically, the punch has a workpiece-deforming surface (or "tip"). To that end, if the punch is mounted on an upper beam of a press brake, its tip is generally oriented downward. The configuration of the tip is dictated by the shape to which one desires to deform a workpiece. In contrast, the die typically has a recess, bounded by one or more workpiece-deforming surfaces, that is aligned with the punch tip. In cases where the punch is mounted on the press brake upper beam, the die in turn is mounted on the lower beam of a press brake, with its recess generally oriented upward. The configuration of the recess corresponds to the configuration of the punch's tip. Thus, when the beams are brought together, a workpiece positioned between them is pressed by the punch into the die to give the workpiece a desired deformation (e.g., a desired bend).

In order to accurately deform a workpiece, it is necessary for the tooling (e.g., punch and die) to be securely mounted to the press. As described above, for a press brake, this generally involves mounting a select punch and a select die on opposing beams of the press brake. In so doing, the punch and die are generally mounted by forcibly clamping each with corresponding holders of such beams. To that end, each punch generally has a first end region adapted to be clamped by the holder, and a second end that forms the tip or working (e.g., bending/deforming) portion thereof. Likewise, each die generally has a first region adapted to be clamped by the holder, and a second region that forms the recess or working portion thereof.

Press tooling designs continue to evolve. For example, some punches and dies have been designed to include separable portions, thereby involving assemblies (i.e., tooling assemblies) instead of single integral bodies. Regarding punch assemblies, the separable portions generally involve a punch tip holder and a punch tip, with these portions configured to be coupled or decoupled as desired. Likewise, die assemblies involve separable die body and die insert portions that can be similarly coupled and decoupled. Such punch and die assembly designs are advantageous, as they enable the punch tips and die inserts to be removed and replaced or sharpened after they wear down. Unfortunately, these designs also tend to have aspects that are less than ideal.

For example, the methods employed in coupling/decoupling the punch tip to/from the corresponding tip holder can be demanding. In particular, the punch tip is often coupled to the tip holder by aligning openings provided along longitudinal extents of their bodies, and then securing fasteners in the aligned openings. However, properly aligning the punch tip and tip holder for coupling there between can be a laborious process, particularly given the sizes and/or weights of conventional punches. Additionally, in many cases, the coupling process requires performing a reference stroke to seat the tip against the holder prior to operatively coupling the tip and holder together. Further, having to tighten/loosen fasteners in the process can be time consuming, difficult to do, or both.

With further reference to the above-described punch assemblies, they have also been found to exhibit reduced integrity and show increased wear over time, as compared to their single integral-body counterparts. For example, when used in pressing operations, a conventional punch assembly formed by conjoining separate holder and tip portions exhibits a diminished structural integrity as compared to an integral-body punch. In addition, pressing operations tend to exert greater stresses on adjoining surfaces of the conjoined portions, thereby causing increased wear in these areas over time.

Further, in some cases, punch assemblies have been found deficient in uniformly distributing pressing force. For example, in some designs, the holder interfaces with the tip at an angle, causing some areas of the holder to encounter greater pressing force than others. This can lead to less than optimum force distribution and transfer to the tip during a deforming/bending process, and the efficiency of the process may consequently be reduced. In addition, increased wear can be found in the areas encountering the greater forces, which impart greater stresses. The above issues often are aggravated when using larger tip sizes.

It should be appreciated that many of the above-described aspects are found to exist with conventional die assemblies as well.

SUMMARY OF INVENTION

Figure 1A:
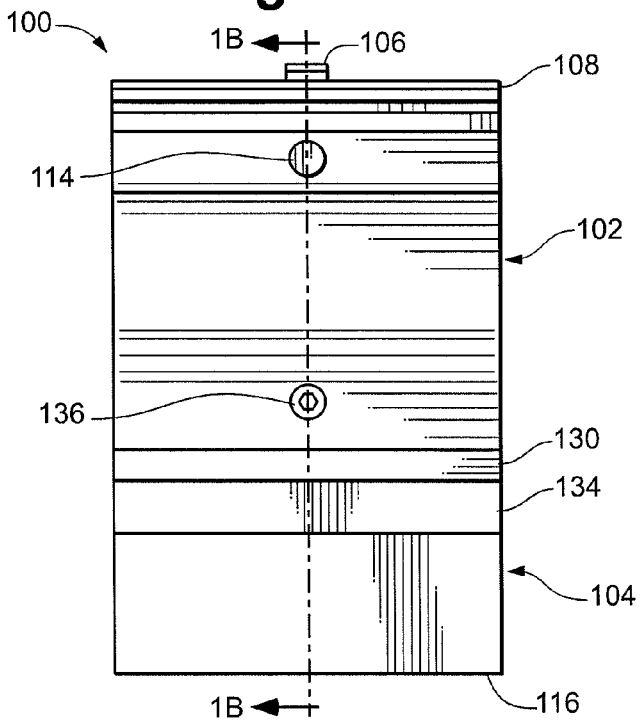
FIGS. 1A, 1B, and 1C are front, cross-sectional, and exploded assembly views, respectively, of a punch assembly in accordance with certain embodiments of the invention, with FIG. 1B also showing a further enlarged view of a section of the assembly.

In certain embodiments, the invention provides a tool assembly configured for being mounted on a tool holder of a press. The tool assembly comprises separable portions. The separable portions include a holder and a tip. The tool assembly includes self-seating structure configured to position and seat a first of the holder and the tip in relation to a second of the holder and the tip. The self-seating structure includes a linking member having first and second end regions. The first end region forms a rigid attachment to a first of the holder and tip. The second end region protrudes from the first of the holder and tip and is adapted for engagement by a second of the holder and tip such that a mount surface of the first of the holder and tip is positioned and seated against a corresponding surface of the second of the holder and tip without further adjustment of the first of the holder and tip being required.

In other certain embodiments, the invention provides a tool assembly configured for being mounted on a tool holder of a press. The tool assembly comprises separable portions. The separable portions include a holder and a tip. The tool assembly includes self-seating structure configured to position and seat the tip in relation to the holder. The self-seating structure comprises a linking member having first and second end regions. The first end region forms a rigid attachment to the tip portion. The second end region protrudes from the tip portion and is adapted for engagement with the holder such that a mount surface of the tip is positioned and seated against a corresponding surface of the holder. The holder receives a coupling member adjustably engaged with the linking member so as to operatively couple the holder and the tip. The coupling member is adjustable in relation to a segment of the linking member.

In further certain embodiments, the invention provides a method of providing a tool assembly for use on a tool holder of a press having a pressing axis. The method comprises the steps of attaching self-seating structure to a tip of the tool assembly; engaging the self-seating structure with a holder of the tool assembly, wherein such engagement of the self-seating structure results in a mount surface of the tip being positioned and seated against a corresponding surface of the holder without further adjustment of the tip; and operatively coupling the tip to the holder by engaging the self-seating structure with a coupling member of the holder.

Optionally, the linking member is not equipped with (e.g., is devoid of) hardware, such as springs, retaining bars, nuts, and the like.

Optionally, during the seating of the tool assembly, the coupling member (or at least a portion of it) moves (e.g., axially) relative to the linking member in a direction crosswise (e.g., perpendicular) to the pressing axis of the tool assembly.

Optionally, the linking member is not integral to the tip body, but is selectively attachable to and removable from the tip.

Optionally, when the tool assembly is operatively assembled, a first end region of the linking member is removably anchored to the tip, while a second end region of the linking member is held securely on the holder by virtue of the coupling member bearing against (e.g., so as to form a rigid connection with) the linking member.

DETAILED DESCRIPTION

The following detailed description should be read with reference to the drawings, in which like elements in different drawings are numbered identically. The drawings depict selected embodiments and are not intended to limit the scope of the invention. It will be understood that embodiments shown in the drawings and described below are merely for illustrative purposes, and are not intended to limit the scope of the invention as defined in the claims.

As described above, tooling designs (e.g., punches and dies) for industrial presses (such as press brakes) continue to evolve. One known design involves punches and dies being provided as assemblies, each involving separable holder and working-end portions—namely punch tip holders and punch tips with regard to punches, and die bodies and die inserts with regard to dies. The punch tips can be removed from the tip holders so that the tips can be sharpened or replaced as desired, and the die inserts can similarly be removed from the die bodies. However, these assembly designs also have aspects that are less than ideal. For example, assembly/disassembly of the separable portions can often involve laborious and time-consuming processes, and unlike their integral body counterparts, the assemblies may have reduced structural integrity and may exhibit increased wear over time.

Despite these limitations, punch and die assemblies have continued to gain in popularity because of their overall efficiency with regard to reuse or replacement of their working-end portions. In addition, these assembly designs have been modified over the years, with the separable portions being formed of different materials. Using different materials for the separable portions has enabled manufacturing costs to be reduced. For example, while the punch tips and die inserts typically necessitate hardened materials, the punch holders or die bodies have been modified so as to be formed of less costly material(s). Thus, despite the less than ideal aspects of the punch and die assemblies commercialized to date, demand continues to grow for these assemblies.

One way in which the present invention improves upon the conventional design of tooling assemblies is by providing an improved manner of assembling the separable portions. In certain embodiments of the invention, as further detailed below, self-seating structure is incorporated in the assemblies. The self-seating structure can take a variety of forms, and can stem from one or more of the separable portions of the assemblies. In use, the self-seating structure preferably facilitates proper positioning and seating of the separable portions in relation to each other, e.g., without further requiring a reference stroke of the press (e.g., without having to press the punch forcibly against the die to seat the tools). (By "seating," "seated," or "seat," it is meant that the mount surface(s) of the tip are secured (e.g., firmly) against the corresponding mount surface(s) of the holder.) Consequently, the self-seating structure eases the process of adjoining the portions, while ensuring that the portions are properly positioned and seated in the process, thereby limiting the number of steps required in coupling the portions.

Applicants have found that when the self-seating structure is also used as a means of operatively coupling the portions together, the design can be particularly advantageous. For example, in using the structure to seat the portions and couple them together in the seated position, a particularly reliable tool assembly can be attained. Consequently, the resulting tool assembly, as compared to conventional tool assemblies, is found to exhibit greater structural integrity and reduced wear in the areas of the seated portions.

Additionally, the self-seating structure of the invention involves no corresponding hardware being associated therewith. To that end, when using punch assemblies with rounded punch tips, as the radii of these tips varies, the self-seating structure needs to be correspondingly changed out to effectively couple the tip to the holder. In such cases, if the self-seating structure had corresponding hardware associated therewith, such hardware would further need to be changed out, adding time and expense to the coupling process. This is not the case with the self-seating structure of the invention, as it is devoid of any separate hardware (e.g., springs, retaining bars, nuts, etc.). More will be said of this later.

Further, the seated surfaces of the conjoined portions can be optionally oriented so that uniform distribution of pressing force through the tool assembly is achieved. For example, the self-seating structure can be configured to have a particular orientation relative to a pressing axis of the press, and, when used to seat surfaces of the separable portions, the structure can function to orient the seated surfaces in relation to the pressing axis so as to promote uniform force distribution. In some cases, these surfaces are oriented to be generally perpendicular to the pressing axis of the press. As such, the pressing force, when delivered, is uniformly distributed across the interface of the seated mounting surfaces. For example, with regard to punch assemblies, the above configuration leads to a more uniform and efficient use of the deforming/bending force from the press, regardless of size of the punch tip. In addition, in uniformly distributing this force, the punch assembly is generally found to exhibit reduced wear over its seated mounting surfaces. These and other advantages of the embodied designs are further described below.

Figure 1B:
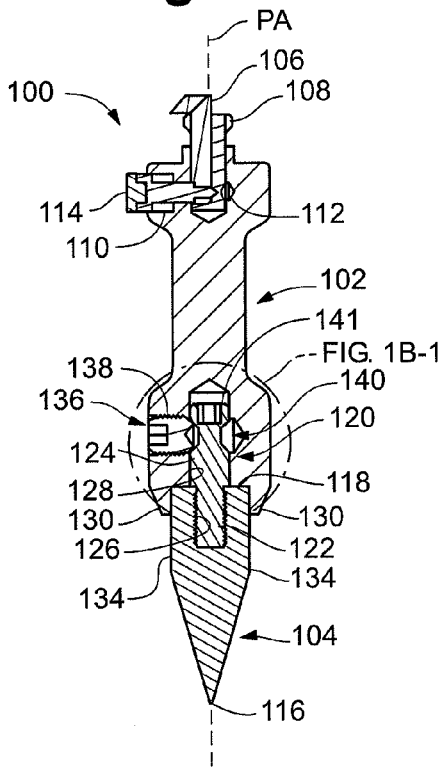
Figures 1, 1B:
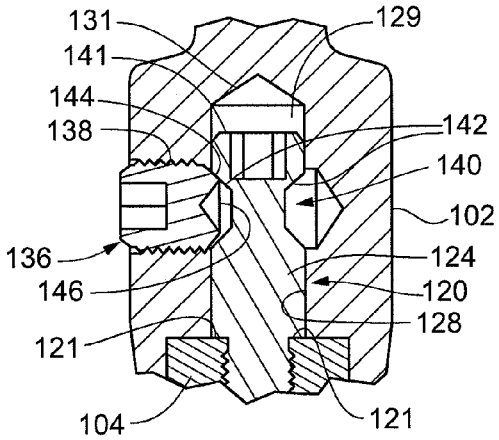
Figure 1C:
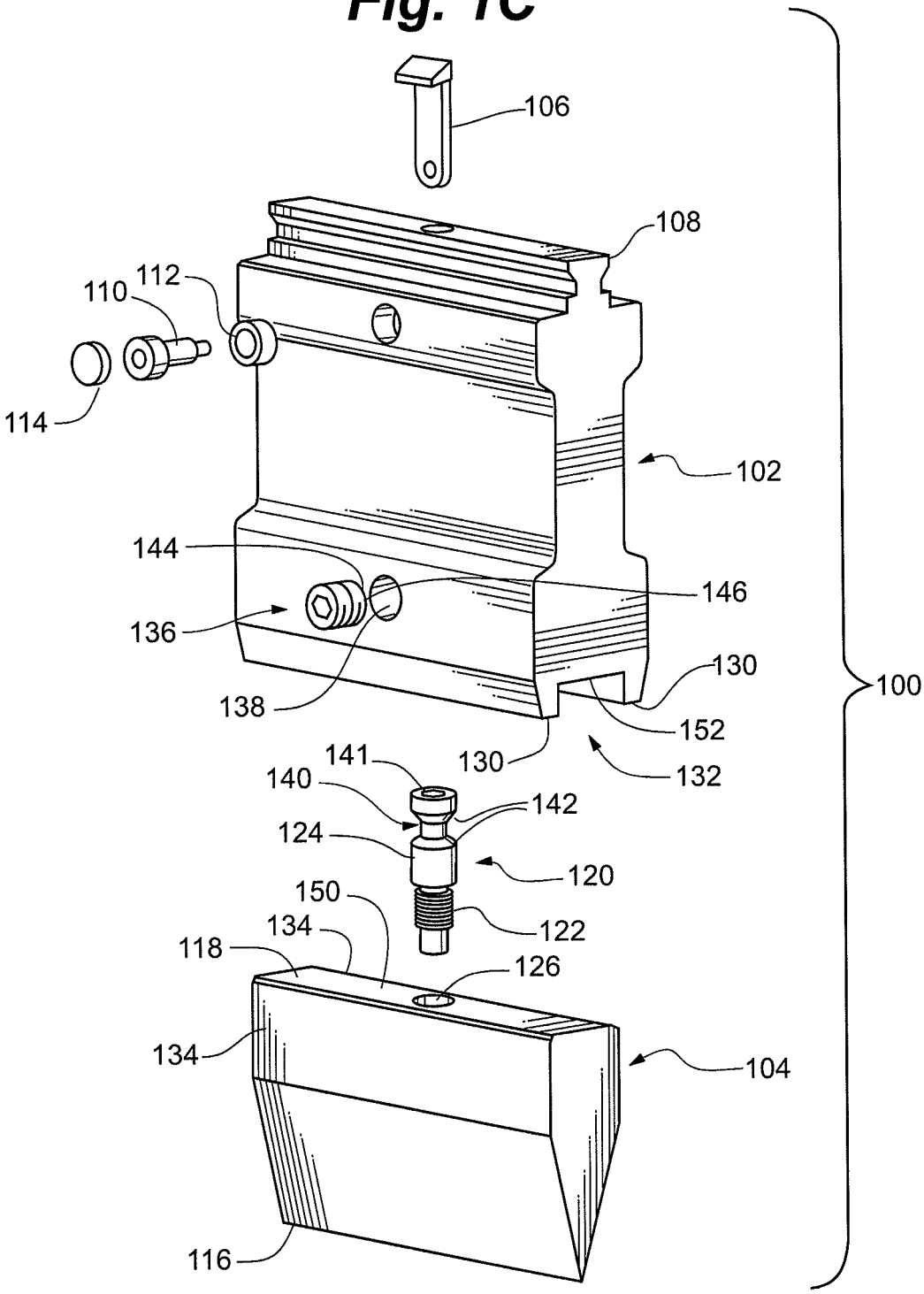

FIGS. 1A, 1B, and 1C (at times collectively referenced herein as FIG. 1) illustrate front, cross-sectional, and exploded assembly views, respectively, of a punch assembly 100 in accordance with certain embodiments of the invention. While some tool assemblies embodied herein are shown involving punch assemblies (as in FIG. 1), it should be appreciated that such embodiments are just as applicable to die assemblies, e.g., as exemplified in FIGS. 3A, 3B, and 3C and described below. In addition, it should be appreciated that the embodied tool assemblies can be American Style, European Style, Wila Style, or any other tooling style that would benefit from having the features of this invention. Further, while being described herein regarding their applicability to a press brake, the tool assemblies are just as applicable to other machines having like functioning, such as folding machines, robotic bending cells, and the like.

Returning to the figures, most notably FIG. 1C, the punch assembly 100 includes two primary portions, a punch tip holder 102 and a punch tip 104, that are configured to be conjoined (i.e., attached to each other) and separated as desired. However, in embodiments involving die assemblies, e.g., as exemplified in FIGS. 3A, 3B, and 3C, the two primary portions correspondingly involve a die body and a die insert. It should be appreciated that when referring to a tool assembly and its tip and holder portions herein, the "tip" can be either a punch tip or a die insert. Likewise, the "holder" can correspondingly be either a punch tip holder or a die body.

In certain embodiments, the punch tip holder 102 is used with (and may be provided in combination with) hardened, tool steel punch tips. Such tool steel often has hardness in the range of 20 HRc to 80 HRc. However, the holder 102 can be used with a variety of tool tips formed of any material, such as other equivalent hardened material(s) or composite material (s), either known in the art (including those currently in less widespread use) or those not yet developed. Alternatively, in some cases, the holder 102 can be adapted for use with tool tips of non-hardened materials that are still applicable for their intended bending/deformation functionality.

Figure 2:
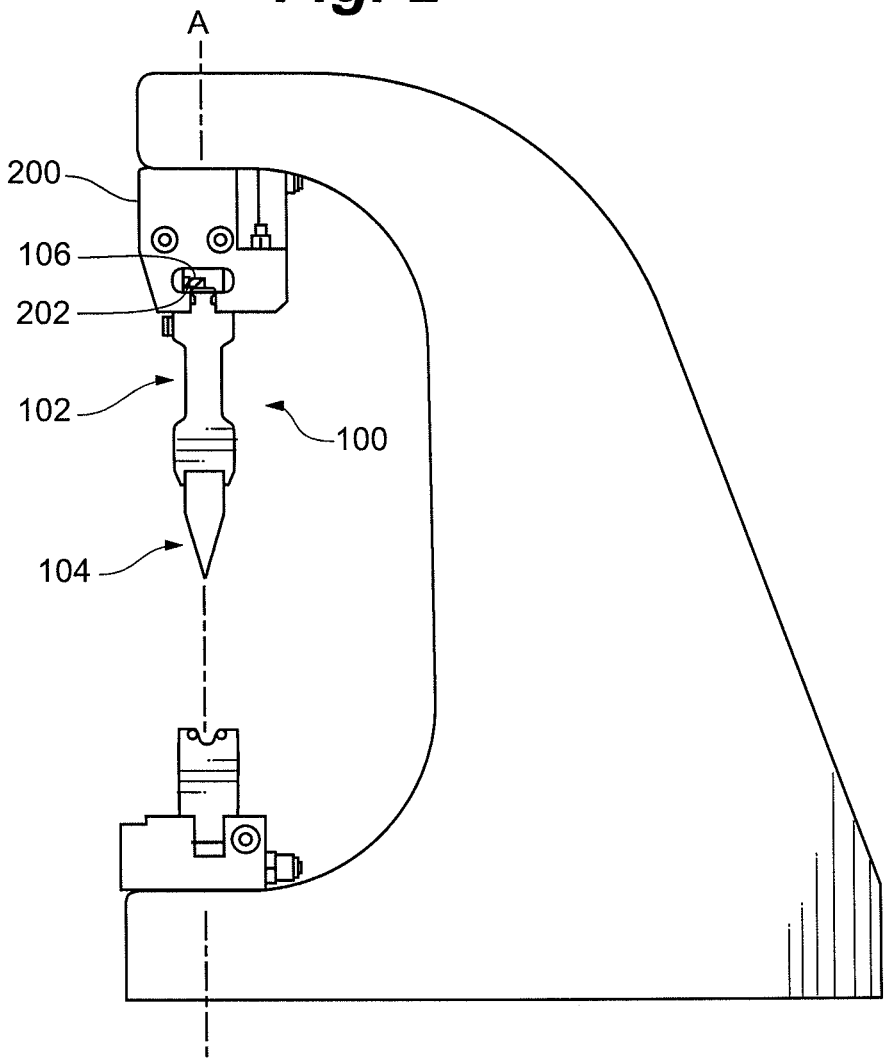
FIG. 2 is a side view of an exemplary set-up of the punch assembly of FIG. 1, mounted and aligned with a corresponding die assembly in a manner that is commonly provided in a press brake.

In some cases, the punch tip holder 102 has a safety key 106. Perhaps as best shown in FIG. 1B, a shank 108 of the holder 102 can optionally have such a safety key 106. FIG. 2 illustrates a side view of an exemplary set-up of the punch assembly 100, mounted and aligned with a corresponding die assembly in a manner that is commonly provided in a press brake. With reference to FIG. 2, the safety key 106 is adapted for engaging a safety recess (or safety groove) 202 and/or moving into alignment with a safety shelf, defined by a press tool holder 200. When provided, the safety key 106 can be retractable or non-retractable. Safety keys of both types are described in U.S. Pat. No. 6,467,327 and U.S. Pat. No. 7,021,116, the entire contents of each of which are incorporated herein by reference. However, it should be appreciated that, while not shown, embodiments can involve the punch tip holder 102 having no safety key.

With reference to FIG. 1B, in the case of a retractable safety key, the key 106 is mounted on the punch tip holder 102 so as to be moveable between an extended position and a retracted position. In more detail, the key 106 preferably comprises a rigid engagement portion 110 that is moveable relative to (e.g., generally toward and away from) the shank 108 of the tip holder 102. In some cases, as shown, the safety key 106 is part of an assembly (e.g., mounted inside and/or on the punch tip holder 102) having at least one spring member 112 resiliently biasing (directly or via one or more link members and/or other bodies) the safety key 106 toward its extended position. Further, in some cases, as shown, the assembly includes a push button 114, which when depressed inwardly moves the engagement portion 110 and the spring member 112 in similar fashion, thereby moving the safety key 106 to its retracted position so as to enable the tip holder 102 to be removable downwardly from the press tool holder.

The tip 104 can be for a male forming punch. However, as alluded to above, it should be appreciated that such tip 104 could just as well be an insert for a female forming die (i.e., a die insert), e.g., as exemplified in FIGS. 3A, 3B, and 3C. Likewise, the holder 102 can be a punch tip holder or a die body. This is true of all embodiments disclosed herein. Typically, the punch tip 104 has generally opposed first and second end regions 116 and 118. Preferably, the first end region 116 of the tip 104 defines a workpiece-deforming surface configured for making a desired deformation (e.g., a bend) in a workpiece when the surface is forced against the workpiece (e.g., when the tip 104 is forced against a piece of sheet metal or the like, and/or when a workpiece is forced against the tip 104). The second end region 118 of the punch tip 104 has one or more surfaces configured for mating with corresponding surface(s) of the punch tip holder 102. In certain embodiments, the second end region 118 defines a planar mounting surface 150 configured to be carried directly against a planar mounting surface 152 defined by the punch tip holder 102, with such surfaces 150, 152 shown in FIG. 1C. More will be said of this later.

As described above, self-seating structure is incorporated in the tool assembly design. One or more of the separable portions (e.g., punch tip holder 102 or punch tip 104) can include such self-seating structure. In such cases, the structure can be coupled to (e.g., operatively coupled to) or integrally formed with a first of the separable portions (e.g., the punch tip 104). As such, the structure (e.g., a linking member thereof) can be configured to form a rigid attachment with, and also to define a segment that protrudes from, the first separable portion. The protruding segment can be configured to mate with a second of the separable portions (e.g., the punch tip holder 102) so as to properly position and seat the first portion in relation to the second portion.

It should be appreciated that there are a variety of configurations for the self-seating structure. As described above, the self-seating structure can be used to position and seat the punch tip 104 in relation to the punch tip holder 102, and in some cases, the structure can also be used in coupling the tip 104 and holder 102 together. For example, in certain embodiments, the self-seating structure includes a linking member 120. With reference to FIG. 1C, in certain embodiments, the linking member 120 is a shaft, rod, pin, or an otherwise elongated member (such as the illustrated pull stud), and includes first and second end regions 122 and 124. In some cases, the linking member is elongated such that, when the tool assembly is mounted operably on a press, the linking member has its central axis generally parallel to a pressing axis of the press. In certain embodiments, the first end region 122 includes a threaded part. When provided, the threaded part of the first end region 122 enables the linking member 120 to be rigidly (e.g., threadingly) attached to one of the separable portions 102 or 104 (e.g., to the punch tip 104), with the second end region 124 protruding from that portion so as to be engageable with (e.g., via a coupling member 136 mounted on) the other portion (e.g., on the punch tip holder 102).

In certain embodiments, the first and second end regions 122, 124 of the linking member 120 are configured to be received within corresponding apertures (e.g., bores) of the separable portions. For example, the illustrated punch tip 104 defines a threaded aperture (e.g., bore) 126 adapted to receive a threaded part of the first end region 122, while the punch tip holder 102 defines a mount aperture (optionally a smooth, non-threaded bore) 128 adapted to receive the second end region 124. Consequently, the second end region 124 is configured to be selectively adjoined to or removed from the holder aperture 128, and as such the holder 102. It should be appreciated that the holder aperture 128 preferably is defined so as to form a snug fit with (e.g., limiting lateral movement of) the linking member's second end region 122. This can provide good positioning and seating of the punch tip 104 on the punch tip holder 102 without requiring a subsequent reference stroke of the press for seating purposes. In certain embodiments, as shown, the aperture 128 has space 129 between a leading end of the linking member's second end region 122 and the illustrated blind end 131 of the mount aperture 128. As should be appreciated, this can also be the case with the other tool holders exemplified in FIGS. 3 and 7-12. Such space 129 can permit the linking member's second end region to be further pulled within the aperture 128 via camming engagement with a coupling member of the holder. More will be said of this later.

While threaded coupling is exemplified for providing rigid attachment between the first end region 122 of the linking member 120 and the punch tip 104, other means of coupling could just as well be used. Further, while only a single linking member 120 is shown in FIG. 1, it should be appreciated that for greater extents (i.e., longer lengths) of the punch assembly 100, a plurality of linking members 120 can be spaced along the length of the punch tip 104. This concept is exemplified in FIGS. 4 and 5, and is also applicable to longer lengths of a die assembly. More will be said of this later.

In some cases, the punch assembly 100 can include further self-seating structure. For example, in certain embodiments, such further structure can include one or more rails (or sidewalls) 130. The rails 130, in certain embodiments, can protrude from an end 132 of the punch tip holder 102 and be adapted to mate with the punch tip 104. As shown, the rails 130 are integral with the punch tip holder 102, but this is not required. In certain embodiments, each of the rails 130 is configured to mate with one or more outer (e.g., side) surfaces of the punch tip 104. For example, with reference to FIG. 1B, each of the rails 130 is configured to mate with opposing outer surfaces 134 of the punch tip 104. Thus, the punch tip holder 102 can have (e.g., define) a mount channel, optionally an elongated rectangular (or generally rectangular) channel into which a mounting end region 118 of the punch tip 104 is configured to be mounted snuggly. The rails 130 can advantageously define sidewalls of the mount channel. In using the rails 130 in combination with a linking member 120, the punch assembly 100 is provided with a two-fold means of positioning and seating the punch tip 104 with the punch tip holder 102.

Upon positioning and seating the punch tip 104 on the punch tip holder 102 via the self-seating structure, a coupling means can optionally be provided to secure the tip 104 to the holder 102. As briefly described above, in certain embodiments, the self-seating structure can be used in such coupling. It should be appreciated that the coupling means can take a variety of forms. For example, the coupling means can involve a coupling member 136, which can optionally be a fastener (or fastener assembly). In certain embodiments, the coupling member 136 is a set screw that the punch tip holder 104 is adapted to receive (e.g., carry). As shown, in certain embodiments, the coupling member 136 is received in a threaded opening (or bore) 138 of the punch tip holder 102, with the opening (or bore) 138 generally oriented so as to intersect (i.e., open into) the aperture (or bore) 128 in the holder 102. In certain embodiments, the aperture (or bore) 128 extends in a direction at least substantially parallel to a pressing axis PA of the assembly 100 (shown in FIG. 1B). As such, movement of the coupling member 136 toward or away from the linking member 120 (i.e., the second end region 124 thereof) can be in a direction crosswise to the assembly's pressing axis PA. In certain embodiments, the movement of the coupling member 136 toward or away from the linking member 120 is axial. Further, in certain embodiments as shown, the crosswise direction is at least substantially perpendicular to the assembly's pressing axis PA. It should be appreciated that the above description is correspondingly applicable to the die assembly 300 of FIGS. 3A, 3B, and 3C, with pressing axis PA of the assembly 300 being shown in FIG. 3B.

With reference to the enlarged section of FIG. 1B, when the second end region 124 of the linking member 120 is inserted into the corresponding aperture (or bore) 128 of the holder 102, the coupling member 136 contacts such second end region 124 as the coupling member is advanced in the threaded opening 138, thereby locking the linking member 120 in place and securing the punch tip 104 in its seated position to the punch tip holder 102. To that end, in the case where the coupling member 136 is provided on the holder 102 (in the opening 138), at least a portion of the member 136 can be movable selectively toward or away from a segment (i.e., second end region 124) of the linking member 120 at such time as that segment is received in the mount aperture (or bore) 128 of the holder 102. In turn and as further detailed below, movement of the coupling member 136 toward the linking member 120 can cause the coupling member portion to bear against said linking member segment so as to seat the tip 104 on the holder 102. As shown, the linking member 120 can optionally have a shoulder 121, that, when operatively mounted to the tip 104, is carried against a mount surface 150 of the tip 104. As shown, this can also be the case, with linking members used is the tool assemblies of FIGS. 3 and 7-12. Here, the mount surface 150 of the tip 104 can optionally contact both the shoulder 121 of the linking member 120 and mount surface 152 of the tip holder 102. Further, movement of the coupling member 136 away from said linking member segment can allow the linking member 120 to be released from the mount aperture (or bore) 136 of the holder 102. It should be appreciated that the above description is correspondingly applicable to the die assembly 300 of FIGS. 3A, 3B, and 3C.

In certain embodiments, as perhaps best shown from the enlarged section of FIG. 1B and FIG. 1C, the second end region 124 of the linking member 120 has a female detent (e.g., an indentation, recess, narrow neck region, and/or channel) 140 formed on or around a portion thereof and optionally bounded on one side by a head 141 of the linking member 120. The female detent 140 provides a seat for the coupling member 136 to extend into when advanced in the opening 138, providing a secure coupling. As further shown, in certain embodiments, the detent 140 has ramped (or "angled") outer surfaces 142 to mate with a correspondingly-configured outer surface 144 at the leading end region 146 of the coupling member 136. In this case, the geometrical engagement of the coupling member's leading end region 146 and the linking member's female detent 140 enables a tighter coupling. In particular, as the coupling member 136 is advanced in the illustrated threaded opening 138, the coupling member's angled surface 144 engages (e.g., makes contact with) the angled outer surfaces 142 of the detent 140. In further advancing the coupling member 136 within the threaded opening 138, the coupling member's leading end region 146 moves further into the detent 140. Consequently, the coupling member's angled surface 144 cams with the detent's angled surfaces 142, and in the process pulls the linking member's second end region 124 into its final, operatively mounted position within the holder aperture 128. Such pulling (and in this case, raising, e.g., for when the assembly 100 is mounted on an upper beam of a press, with a representation of such provided in FIG. 2) of the linking member 120 within the holder aperture 128 provides a tight coupling between punch tip 104 and punch tip holder 102, eliminating or limiting any gaps or tolerances between the adjoined surfaces of the tip 104 and holder 102, thereby providing a tightly-bound assembly without the need to perform a prior reference stroke of the press (for seating purposes). In other embodiments (not shown), the coupling means (e.g., the fastener 136), when provided, simply bears forcibly against the side of a linking member that has no female detent. Or, other types of female detents can be used. Further, while the illustrated coupling means can be an externally threaded set screw, various other coupling means can be used. For example, a body can be spring biased (or otherwise forced) into engagement with the linking member.

As briefly described above, by incorporating self-seating structure (e.g., a linking member 120) in tool assembly designs to position and seat, and/or to couple, the tip holder and tip portions, the design can ease the assembly process and also have a favorable impact on the performance and durability of the tool assembly. For example, as described above, in using the structure to initially seat the portions and then couple them together in the seated position, a tightly-bound tool assembly is attained. Consequently, the resulting tool assembly, in comparison to conventional tool assemblies, exhibits enhanced structural properties. For example, in coupling the linking member 120 in its operative position with the punch tip holder 102, unwanted gaps between the tip 104 and holder 102 are eliminated or limited in the resulting punch assembly 100. Thus, when operatively assembled, the engaged mating surfaces of the punch tip and punch tip holder preferably are maintained in stable, direct contact with one another at all times during pressing operations. Consequently, the assembly 100 can exhibit greater structural integrity and reduced wear in areas of the seated portions.

Further, in certain embodiments with reference to FIG. 1C, the self-seating structure (the linking member 120, and optionally, the rails 130) are configured such that mating mount surfaces 150 and 152 of the tip 104 and tip holder 102, respectively, are maintained in a particular orientation with respect to the pressing axis of the press. In certain embodiments, the linking member 120 protrudes from the punch tip 104 in a direction (e.g., along an axis) parallel (or substantially parallel) to the pressing axis of the press. As such, in certain embodiments, the mating surfaces 150, 152, once seated (i.e., carried directly against each other in their operative position), are perpendicular (or substantially perpendicular) to the pressing axis. In FIG. 2, the illustrated pressing axis A is generally vertical, although this is not strictly required. As such, the corresponding vertically-oriented pressing force, when delivered to the punch assembly 100, is uniformly distributed across the entire interface area of the seated surfaces 150, 152. This leads to a more uniform and effective use of the deforming/bending force from the press, regardless of size of the punch tip. In addition, in uniformly distributing this force, the punch assembly 100 may produce less wear proximate to the seated surfaces 150, 152 in comparison to what is typically exhibited in using conventional punch assemblies.

Figure 3A:
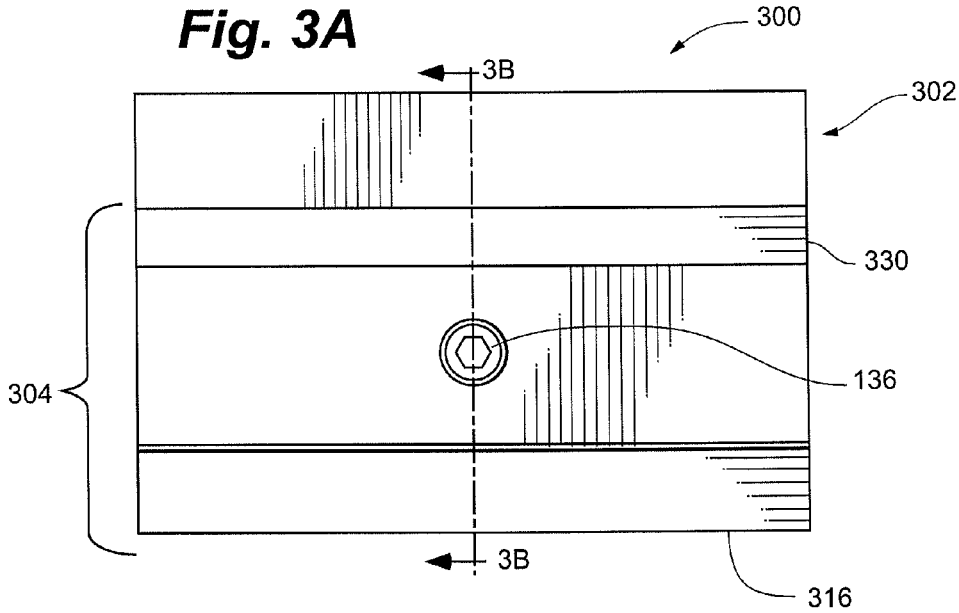
FIGS. 3A, 3B, and 3C are front, cross-sectional, and exploded assembly views, respectively, of a die assembly in accordance with certain embodiments of the invention, with FIG. 3B also showing a further enlarged view of a section of the assembly.
Figure 3B:
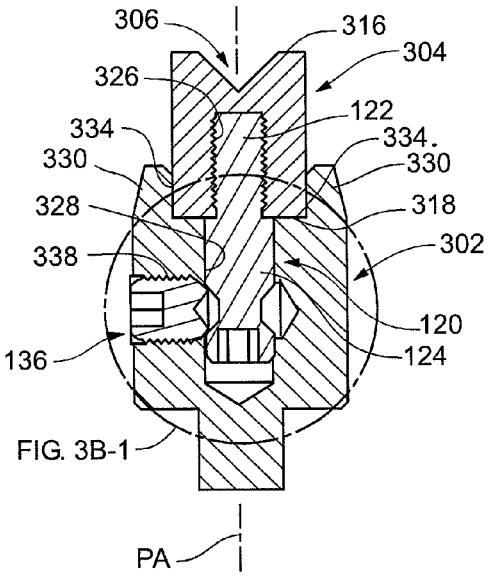
Figures 1, 3B:
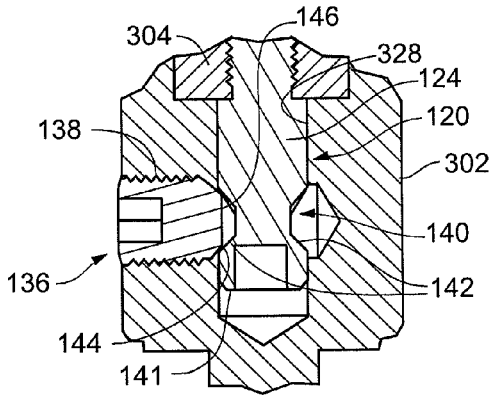
Figure 3C:
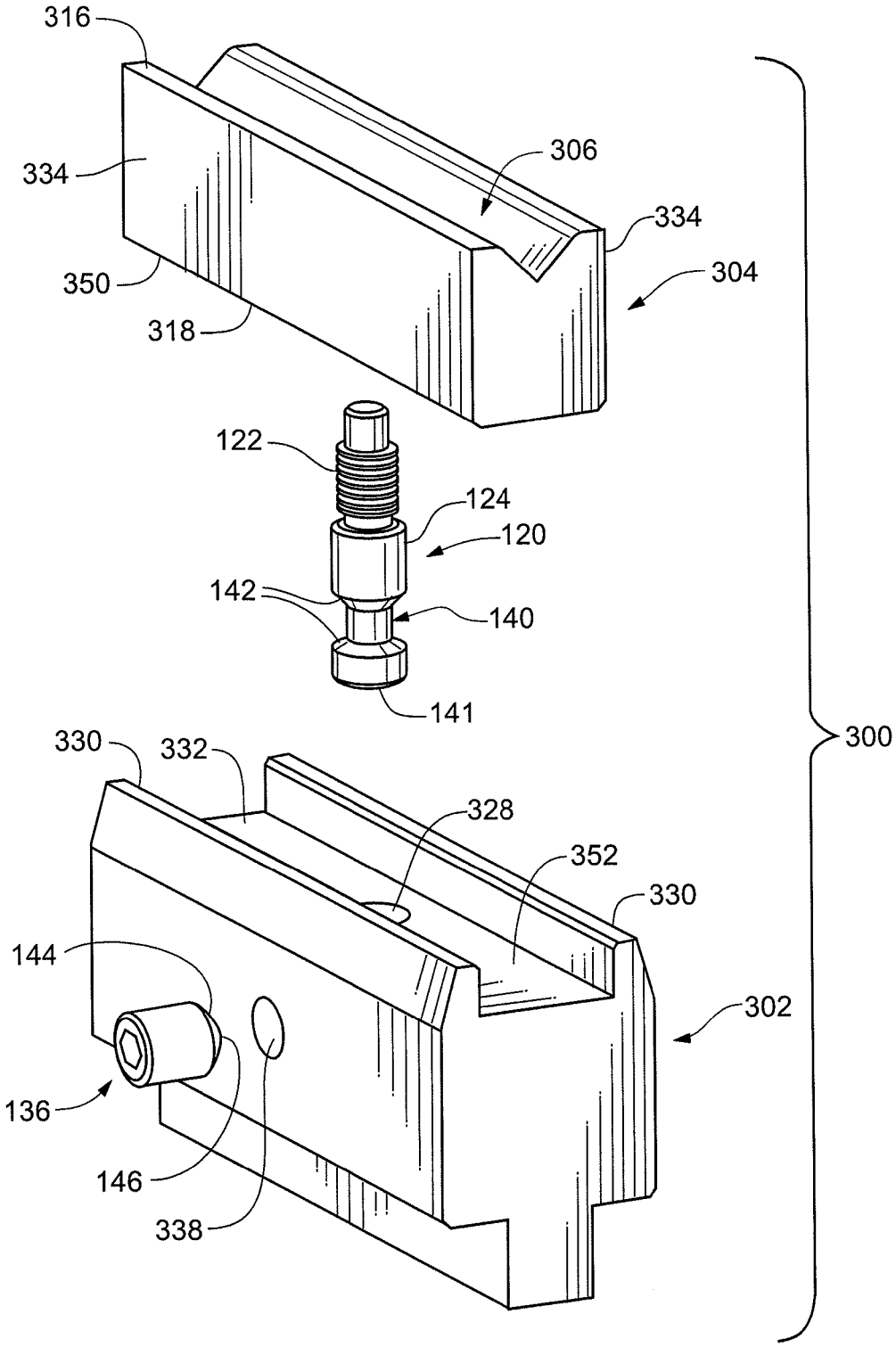

As alluded to above, embodiments of the invention are just as applicable to die assemblies, and this is exemplified in FIGS. 3A, 3B, and 3C (at times collectively referenced herein as FIG. 3), which illustrate front, cross-sectional, and exploded assembly views, respectively, of a die assembly 300. Similar to the punch assembly 100 of FIG. 1, the die assembly 300 includes two primary portions configured to be conjoined and separated as desired, but in this case, the portions involve a die body 302 and a die insert 304.

In certain embodiments, the die body 302, similar to the punch tip holder 102 described above, is used with (and may be provided in combination with) hardened, tool steel die inserts. However, the die body 302 can be used with a variety of die inserts formed of any material, such as other equivalent hardened material(s) or composite material(s), either known in the art (including those currently in less widespread use) or those not yet developed. Alternatively, in some cases, the body 302 can be adapted for use with inserts of other hard or non-hardened materials that are applicable for their intended bending/deformation functionality. For example, in certain embodiments, the die insert 304 can be formed of a hard steel of a polymer/composite material (e.g., via molding, casting, or extruding), with the material being more beneficial in applications in which mark-free bending is warranted, e.g., such as involving polished or painted materials.

As shown, the die insert 304 has generally opposed first and second end regions 316 and 318. Preferably, the first end region 316 of the insert 304 defines a recess (or "channel") 306, bounded by one or more workpiece-deforming surfaces. The first end region 316 of the insert 304, when used in a press, is aligned with a corresponding punch and generally supports a workpiece thereon. During a pressing operation, a desired deformation (e.g., a bend) is created in the workpiece when the punch is forced against the workpiece (e.g., when the punch tip is forced against a piece of sheet metal or the like, and/or when a workpiece is forced against the tip), with the workpiece being bent according to a shape of the insert recess 306. The second end 318 of the illustrated die insert 304 has one or more surfaces configured for mating with corresponding surface(s) of the die body 302. In certain embodiments, the second end 318 defines a planar mounting surface 350 configured to be carried directly against a planar mounting surface 352 defined by the die body 302, with such surfaces 350, 352 shown in FIG. 3C.

Similar to the punch assembly 100 of FIG. 1, self-seating structure is incorporated in the design of the die assembly 300, with this structure sharing many of the same attributes and functionality described above with regard to the punch assembly 100. For example, as shown, the self-seating structure includes a linking member 120. As already described, the linking member 120 can include first and second end regions 122 and 124, with the first end region 122 optionally including a threaded part. When provided, as shown, the threaded part of the first end region 122 enables the linking member 120 to be rigidly (e.g., threadingly) attached to one of the separable portions 302 or 304 (e.g., to the die insert 304), with the second end region 124 protruding from that portion so as to be engageable with (e.g., via a coupling member 136 mounted on) the other portion (e.g., on the die body 302).

In certain embodiments, the first and second end regions 122, 124 of the linking member 120 are configured to be received within corresponding apertures (e.g., bores) of the separable portions. For example, the illustrated die insert 304 defines a threaded aperture (e.g., bore) 326 adapted to receive a threaded part of the first end region 122, while the die body 302 defines an aperture (optionally a smooth, non-threaded) 328 adapted to receive the second end region 124. Consequently, the second end region 124 is configured to be selectively adjoined to or removed from the body aperture 328, and as such the body 302. It should be appreciated that the die body aperture 328 preferably is defined so as to form a snug fit with (e.g., limiting lateral movement of) the linking member's second end region 122, resulting in good positioning and seating of the die insert 304 on the die body 302.

In some cases, as shown, the die assembly 300 includes further self-seating structure, such as one or more rails (or sidewalls) 330. Such rails 330, in certain embodiments, can protrude from an end region 332 of the die body 302 and be adapted to mate with the die insert 304. As shown, the rails 330 are integral with the die body 302, but this is not required. In certain embodiments, each of the rails 330 is configured to mate with one or more outer (e.g., side) surfaces of the die insert 304. For example, with reference to FIG. 1B, each of the rails 130 is configured to mate with opposing outer (e.g., side) surfaces 334 of the die insert 304. Thus, similar to the punch tip holder 102, the die body 302 can have (e.g., define) a mount channel, optionally an elongated rectangular (or generally rectangular) channel, into which a mounting end region 318 of the die insert 304 is configured to be mounted snuggly. The rails 330 can advantageously define sidewalls of the mount channel. In using the rails 330 in combination with a linking member 120, the die assembly 300 can be provided with a two-fold means of positioning and seating the die insert 304 on the die body 302.

Upon positioning and seating the die insert 304 on the die body 302 via the self-seating structure, a coupling means (e.g., a coupling member) can optionally be provided to secure the insert 304 to the body 302, e.g., similar to that already described with respect to the punch assembly 100. To that end, in certain embodiments, the self-seating structure can be used in such coupling, with a coupling means involving the same type of coupling member 136, such as a fastener or fastener assembly, optionally involving a set screw, as described above. As such, in certain embodiments, the coupling member 136 is received in a threaded opening (or bore) 338 of the die body 302, with the opening (or bore) 338 generally oriented so as to intersect (i.e., open into) the aperture (or bore) 328 in the body 302. As such, with reference to the enlarged section of FIG. 3B, when the second end region 124 of the linking member 120 is inserted into the corresponding aperture (or bore) 328 of the body 302, the coupling member 136 contacts such second end region 124 as the coupling member is advanced in the threaded opening 338, thereby locking the linking member 120 in place and securing the die insert 304 in its seated position on the die body 302.

As should be appreciated from the drawings, perhaps as best shown from the enlarged section of FIG. 3B and FIG. 3C, the second end region 124 of the linking member 120, in certain embodiments, has a female detent 140 as described above with regard to embodiments concerning the punch assembly 100. To that end, the female detent 140 provides a seat for the coupling member 136 to extend into when advanced in the opening 338, providing a secure coupling. As also described above, in certain embodiments, the detent 140 has ramped (or "angled") outer edges 142 to mate with a correspondingly-configured outer surface 144 at the leading end region 146 of the coupling member 136. As such, the geometrical engagement of the coupling member's leading end region 146 and the linking member's female detent 140 enables a tighter coupling via pulling of the linking member second end region 124 (as much as possible) into its final, operative mounted position within the die body aperture 328. Such pulling (and in this case, lowering, e.g., for when the assembly 300 is mounted on a lower beam of a press, with a representation of such provided in FIG. 2) of the linking member 120 within the aperture 328 provides a tight coupling between die insert 304 and die body 302, eliminating or limiting any gaps or tolerances between the adjoined surfaces of the insert 304 and body 302, thereby providing a tightly-bound assembly without the need to perform a prior reference stroke of the press (for seating purposes). As described above, in other embodiments (not shown), the coupling means (e.g., the fastener 136), when provided, simply bears forcibly against the side of a linking member that has no female detent. Or, other types of female detents can be used. Further, while the illustrated coupling means can be an externally threaded set screw, various other coupling means can be used. For example, a body can be spring biased (or otherwise forced) into engagement with the linking member.

Similar to that described above with regard to the punch assembly 100, by incorporating self-seating structure (e.g., a linking member 120) in die assembly designs to position and seat, and/or to couple, the die body and insert portions, the design can ease the assembly process and also have a favorable impact on the performance and durability of the die assembly. For example, as described above, a tightly-bound die assembly is attained, which in comparison to conventional die assemblies, exhibits enhanced structural properties. For example, in coupling the linking member 120 in its operative position with the die body 302, unwanted gaps between the insert 304 and body 302 are eliminated or limited in the resulting die assembly 300. Thus, when operatively assembled, the engaged mating surfaces of the die body and insert portions preferably are maintained in stable, direct contact with one another at all times during pressing operations. Consequently, the assembly 300 can exhibit greater structural integrity and reduced wear in areas of the seated portions.

Further, in certain embodiments with reference to FIG. 3C, the self-seating structure (the linking member 120, and optionally, the rails 330) are configured such that mating surfaces 350 and 352 of the die insert 304 and die body 302, respectively, are maintained in a particular orientation with respect to the pressing axis of the press. In certain embodiments, the linking member 120 protrudes from the die insert 304 in a direction (e.g., along an axis) parallel (or substantially parallel) to the pressing axis of the press. As such, in certain embodiments, the mating surfaces 350, 352, once seated (i.e., carried directly against each other in their operative position), are perpendicular (or substantially perpendicular) to the pressing axis, which is commonly vertical in pressing configurations (as illustrated in FIG. 2). Such orientation of the die assembly 300 is particularly useful in pressing operations in which the die assembly (and workpiece thereon) is forced toward and against a stationary punch. In such cases, the corresponding vertically-oriented pressing force, when delivered to the die assembly 300, is uniformly distributed across the entire interface area of the seated surfaces 350, 352. This leads to a more uniform and effective use of the deforming/bending force from the press, regardless of size of the die insert. In addition, in uniformly distributing this force, the die assembly 300 may produce less wear proximate to the seated surfaces 350, 352 in comparison to what is typically exhibited in using conventional die assemblies.

In summary, the invention provides embodiments wherein self-seating structure is provided in a tool assembly (punch or die assemblies), which allows for separable portions of the assembly to be effectively positioned and seated in relation to each other, thereby simplifying their assembly and ensuring proper positioning and seating of the portions during assembly. The above description also provides an example where the self-seating structure (e.g., a linking member 120) is used in operatively coupling the separable portions, whereby the resultant assembly is tightly bound so as to enhance its structural integrity and reduce wear, particularly at the adjoined surfaces of the portions. Further, by configuring the self-seating structure (the linking member 120, and optionally, the rails 130 or 330) to seat corresponding surfaces of the separable portions so that the surfaces are uniformly perpendicular to the pressing axis, a more uniform transfer of pressing force can result between the portions, further enabling less wear there between.

As alluded to above, while only a single linking member 120 is shown in FIG. 1, greater extents (i.e., longer lengths) of the punch assembly 100 generally involve a plurality of linking members 120 appropriately spaced along the length of the punch tip 104. This concept is exemplified in FIGS. 4 and 5, and is further applicable to longer lengths of die assemblies as well. In particular, while showing a different style than punch tip 104, the punch tip 404 of FIG. 4 includes a plurality of spaced-apart linking members 120 (not shown) as demonstrated by the spaced apertures (or bores) 438 along a side surface 406 of its adjoined punch tip holder 402. As described above, these apertures (or bores) 438 can be configured to receive coupling means (e.g., coupling members), each for respectively retaining a linking member 120 (not shown) extending into the holder 402 from the punch tip 404.

Figure 4:
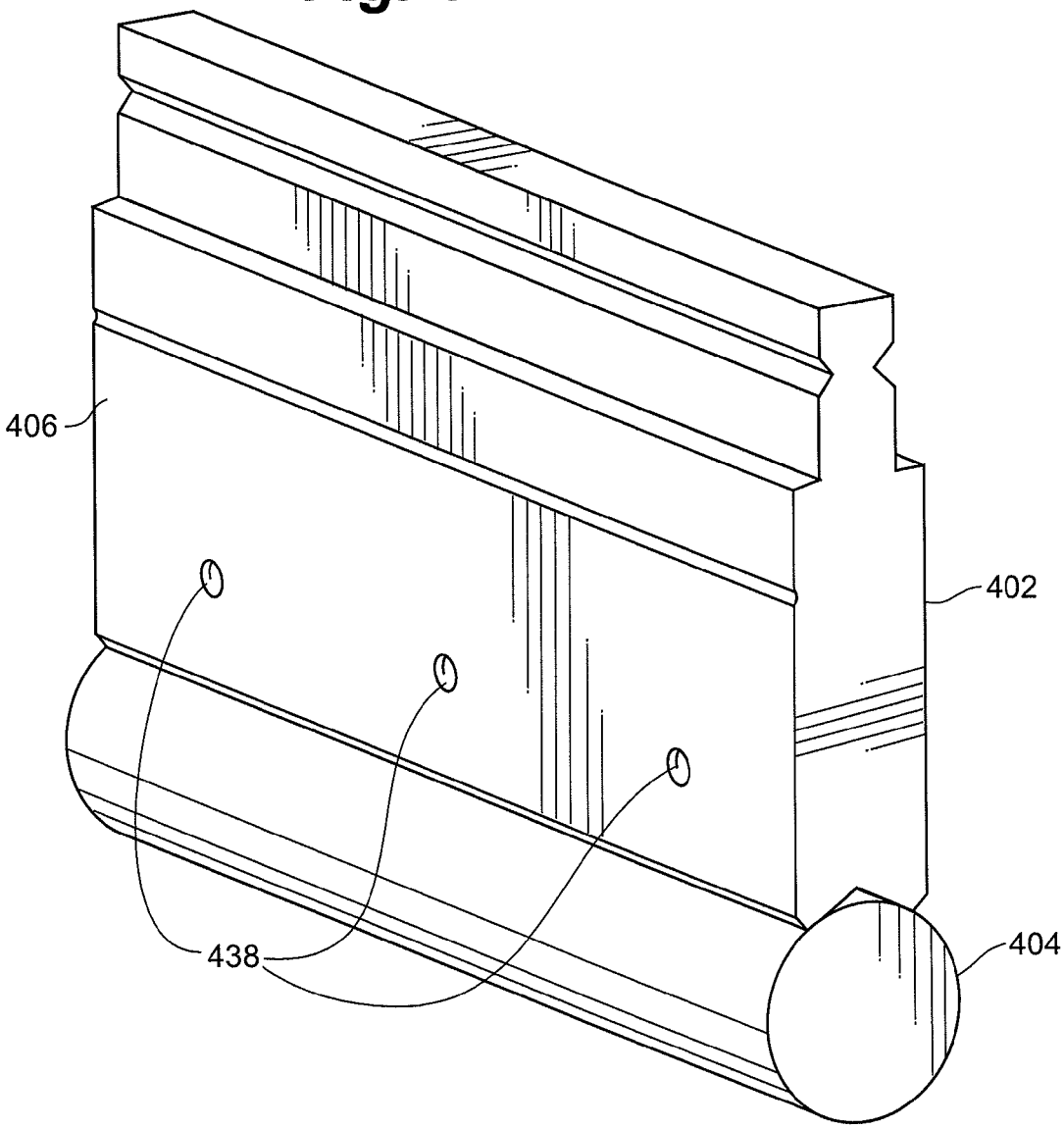
FIG. 4 is a side perspective view of a further punch assembly in accordance with certain embodiments of the invention.
Figure 5:
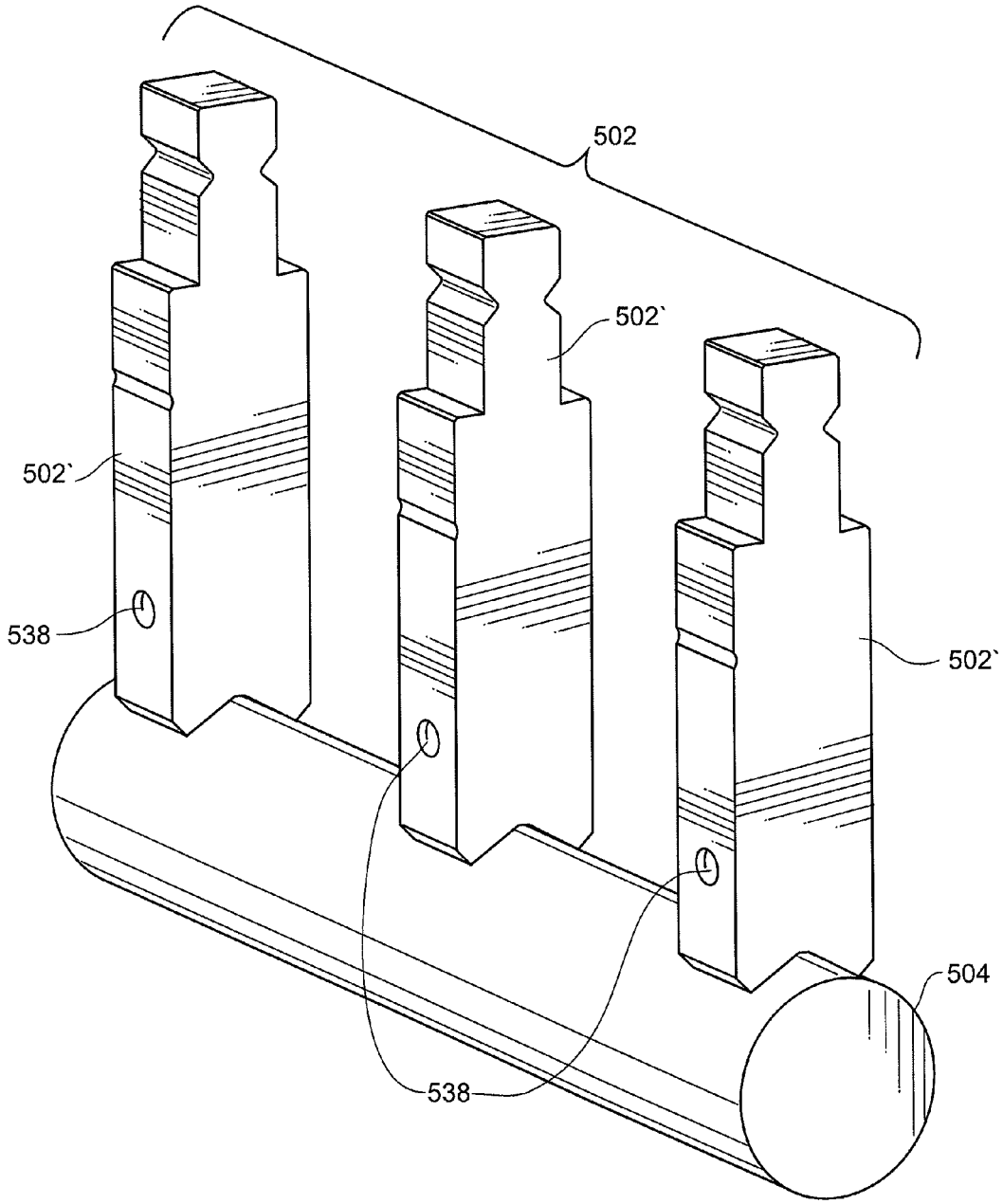
FIG. 5 is a side perspective view of another punch assembly in accordance with certain embodiments of the invention.

It should be appreciated that various configurations of the punch tip holder 402 can be used. In certain embodiments, as shown in FIG. 4, the holder 402 can involve a single, integral body. Alternatively, in certain embodiments, the punch tip holder can be segmented, with its segments being spaced or conjoined. For example, as shown in FIG. 5, the holder 502 involves a plurality of spaced-apart punch tip holder segments 502', each configured to be operatively coupled to a punch tip 504. An aperture 538 is exemplarily shown in each segment 502'. As described above, these apertures 538 can each be configured to receive coupling means for respectively retaining a linking member 120 (not shown) for coupling the segment 502' to the punch tip 504 (similar to the design already described). It should be appreciated that other coupling designs can be alternatively used.

Referring back to FIGS. 1 and 3, sections of a punch assembly and a die assembly are illustrated, respectively. It is known that press tooling (e.g., for press brakes) is generally manufactured in standard lengths, e.g., 500 mm, 835 mm, 36", etc. For longer tooling lengths, it should be appreciated that the self-seating structure, when involving linking members 120 as exemplified above, may advantageously include a plurality of such bodies 120 appropriately coupled and spaced along the length of the tool assembly, with apertures (e.g., bores) correspondingly positioned along the length of the punch tip holder 102. However, instead of being limited to standard tooling lengths, in certain embodiments, the tooling assembly 100 can be configured to be modular so as to form any desired length. It should be appreciated that the length of the punch tip 104 (generally in the range from 1' to 20') makes it preferable to use a single integral body, so as not to compromise its deforming/bending function. However, in certain embodiments, the punch tip holder 102 is formed of sections, with such sections aligned to form the length needed to accommodate the extent of the punch tip 104. This may likewise be the case with the die assembly.

Figure 6:
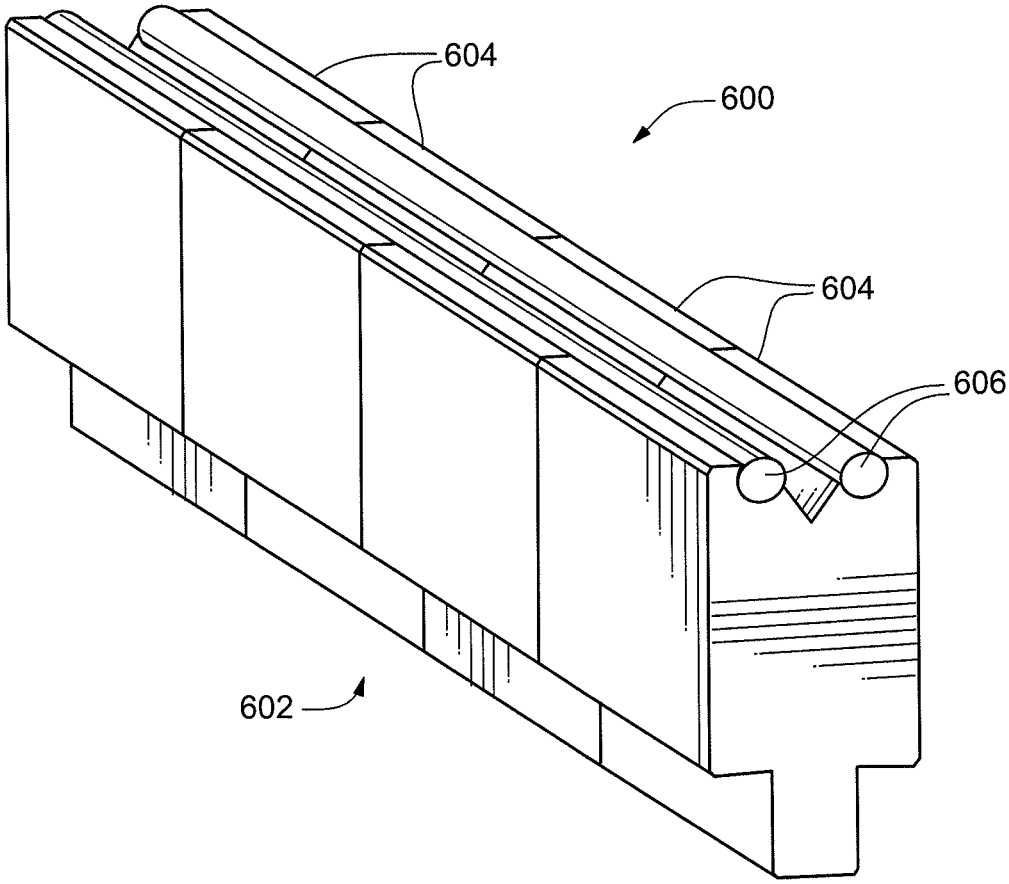
FIG. 6 is a side perspective view of a modular die body in accordance with certain embodiments of the invention.

An example of a segmented tooling holder, modular in design, is illustrated in FIG. 6. Differing from FIGS. 4 and 5, FIG. 6 illustrates a die body 602; however, similar to FIGS. 4 and 5, its design is applicable to both punch and die assemblies. The die body 602 is formed of a plurality of aligned sections 604, as opposed to the die body 302 illustrated in FIGS. 3A, 3B, and 3C. While the die body 602 of FIG. 6 is shown as having four sections 604 to accommodate the extent of a die insert (not shown, but generally having similar extent to die bars 606 shown), it should be appreciated that the length of the die body 602 can be adjusted as needed by adding/removing one or more sections 604 to/from the assembly 600 and/or using sections 604 of varying lengths. The sections 604, once provided, can be adjoined in any of a variety of ways. For example, while not shown, each of the sections 604 can include a fastener and an aperture on opposing ends thereof (e.g., such as a fastener like the linking member 120 and its corresponding apertures described above). As such, in certain embodiments, each of the opposing ends of the sections 604 can include a fastener and an aperture, respectively, wherein the aperture of one section 604 is configured to accept the fastener of an adjoining section 304, and so on, in forming the tool holder assembly 600 to its desired length.

Many other means can alternatively be used to secure together such multiple sections 604.

As noted above, other means can be used in coupling the linking member 120, and thereby the separable portions of the punch or die assemblies 100, 300 together. While the above-described embodiments exemplify the coupling member 136 as a set screw, other fasteners or fastening designs can alternately be used. Additionally, the coupling means can involve mechanisms that secure the linking member without requiring use of a tool. As such, joining and coupling the linking member (and thereby, the punch tip) with the holder can performed via a tool-less (or "tool-free") operation, and in some embodiments, by a single motion, tool-free operation. Furthermore, in certain embodiments, the coupling means can involve mechanisms that have releasing functionality in addition to their securing functionality such that assembly and disassembly processes can both be performed via a tool-less operation, and in certain embodiments, via a single motion, tool-free operation.

Figure 7B:
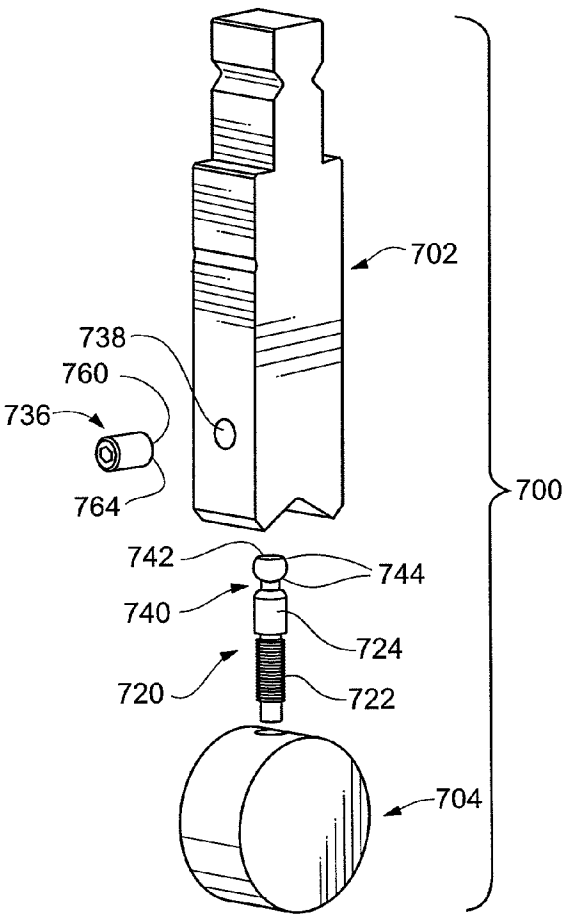
FIGS. 7A and 7B are cross-sectional and exploded assembly views, respectively, of a further punch assembly having a coupling design involving an exemplary fastener in accordance with certain embodiments of the invention, with FIG. 7A also showing a further enlarged view of a section of the assembly.
Figures 1, 7A:
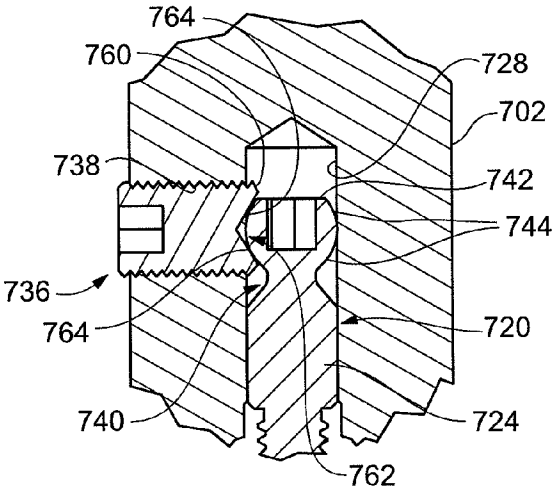
Figure 7A:
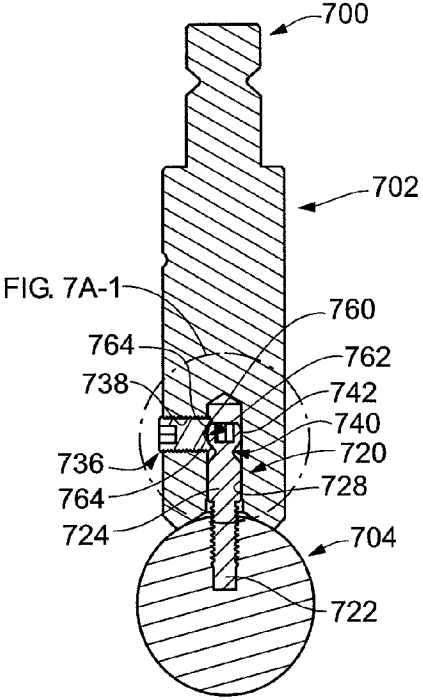
Figure 8B:
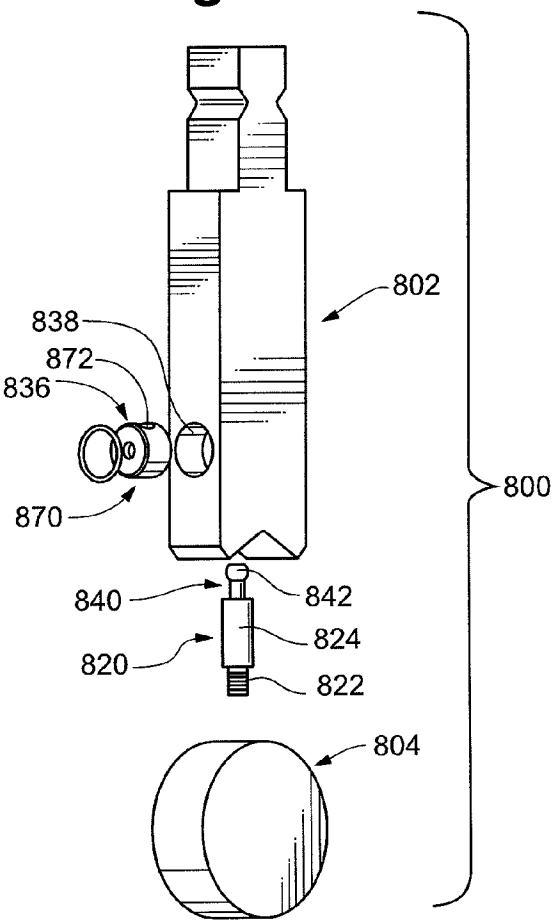
FIGS. 8A and 8B are cross-sectional and exploded assembly views, respectively, of an additional punch assembly having a coupling design involving an exemplary fastener in accordance with certain embodiments of the invention, with FIG. 8A also showing a further enlarged view of a section of the assembly.
Figures 1, 8A:
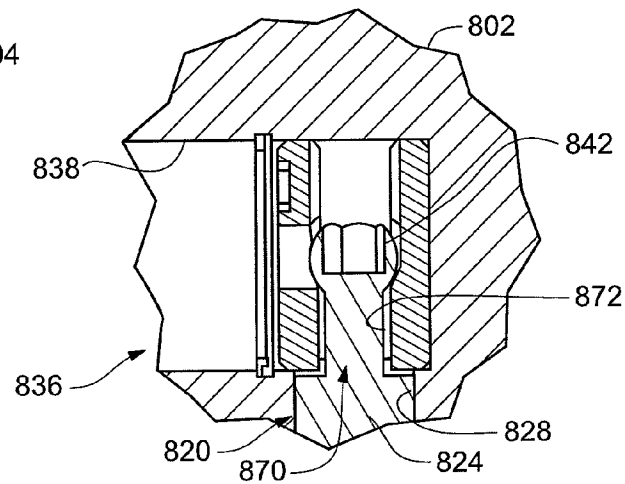
Figure 8A:
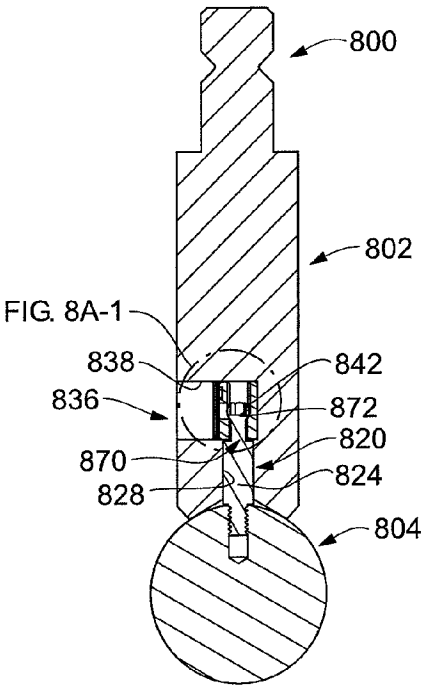
Figure 9B:
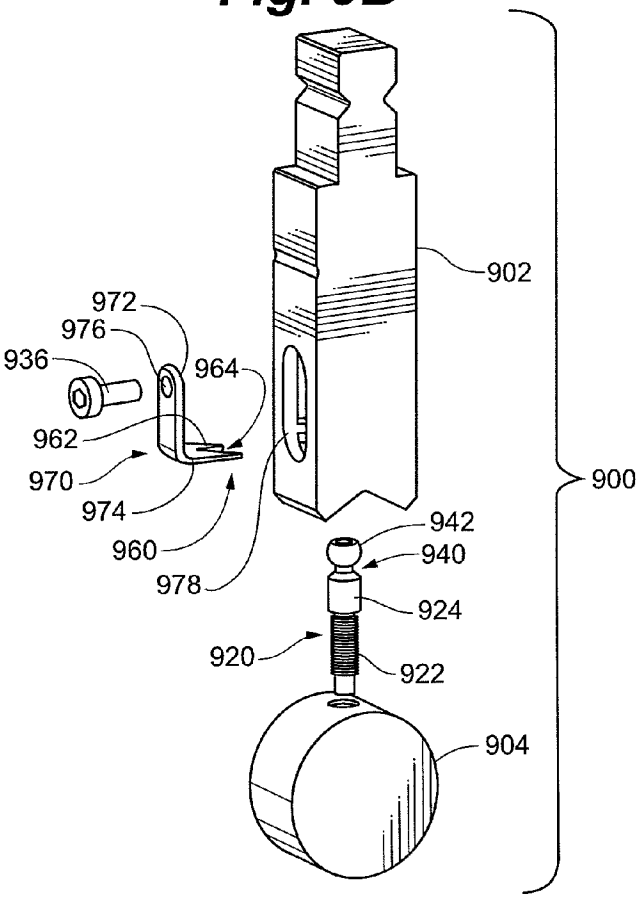
FIGS. 9A and 9B are cross-sectional and exploded assembly views, respectively, of another punch assembly having a coupling design involving an exemplary fastener assembly in accordance with certain embodiments of the invention, with FIG. 9A also showing a further enlarged view of a section of the assembly.
Figures 1, 9A:
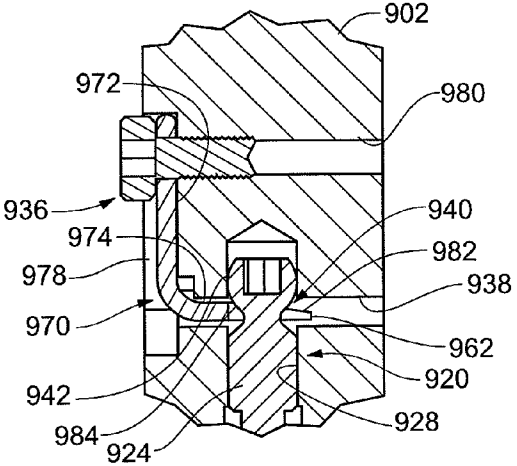
Figure 9A:
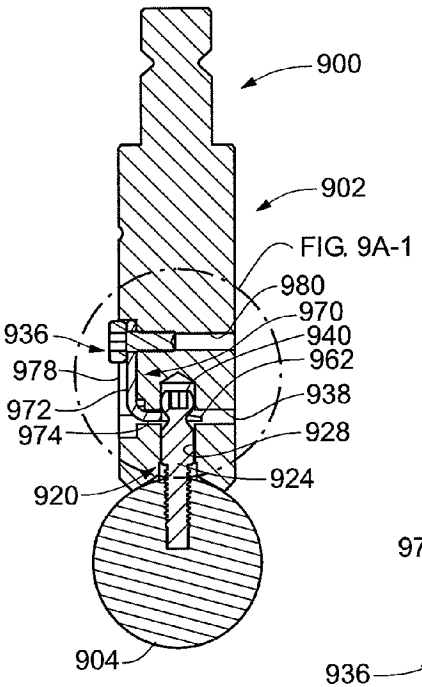
Figure 10B:
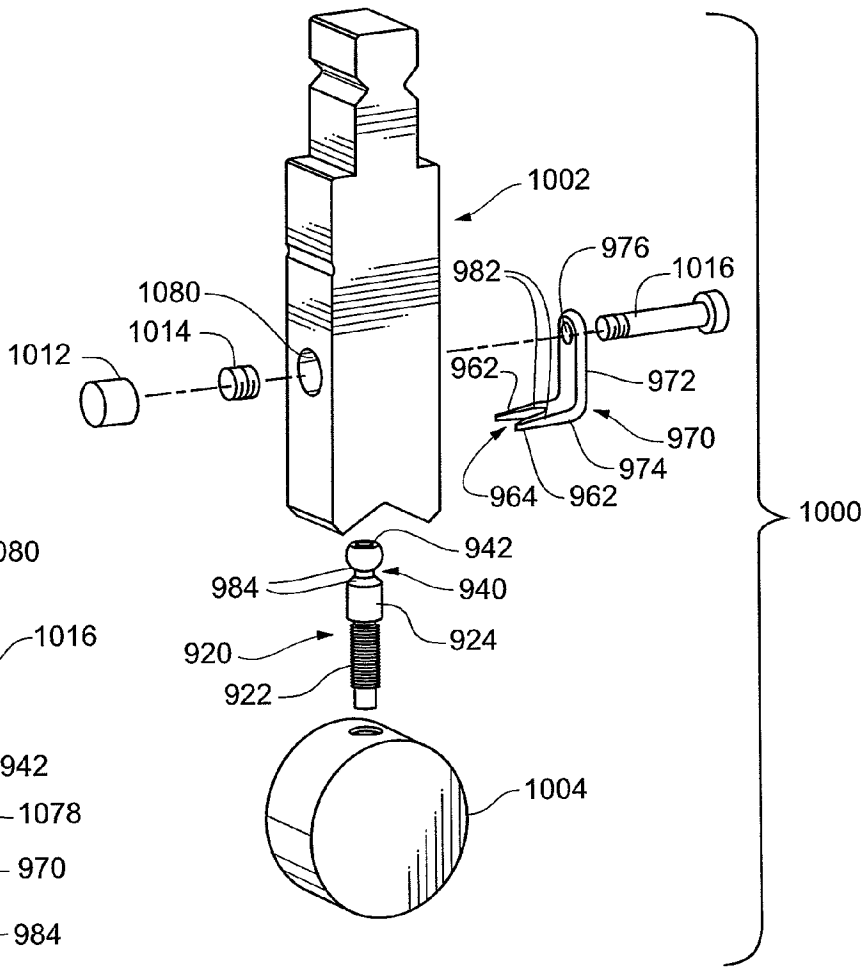
FIGS. 10A and 10B are cross-sectional and exploded assembly views, respectively, of a further punch assembly having a coupling design involving an exemplary securing and release mechanism in accordance with certain embodiments of the invention, with FIG. 10A also showing a further enlarged view of a section of the assembly.
Figures 1, 10A:
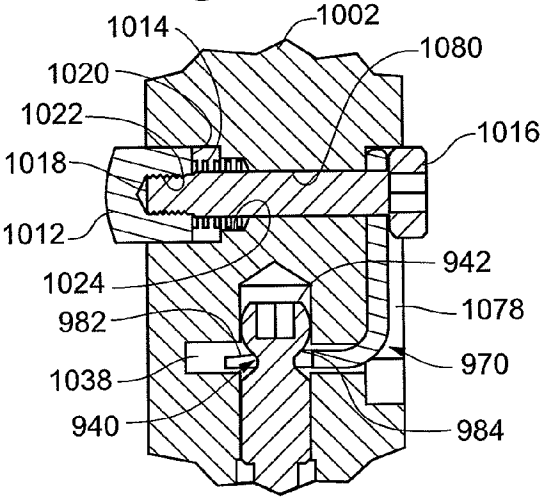
Figure 10A:
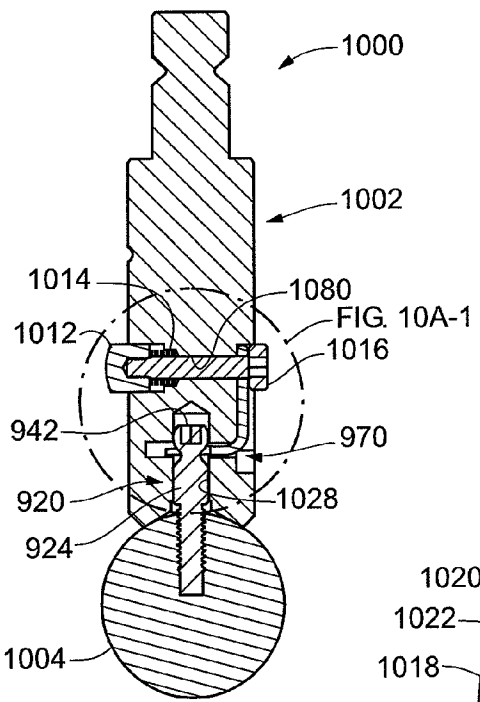
Figure 11B:
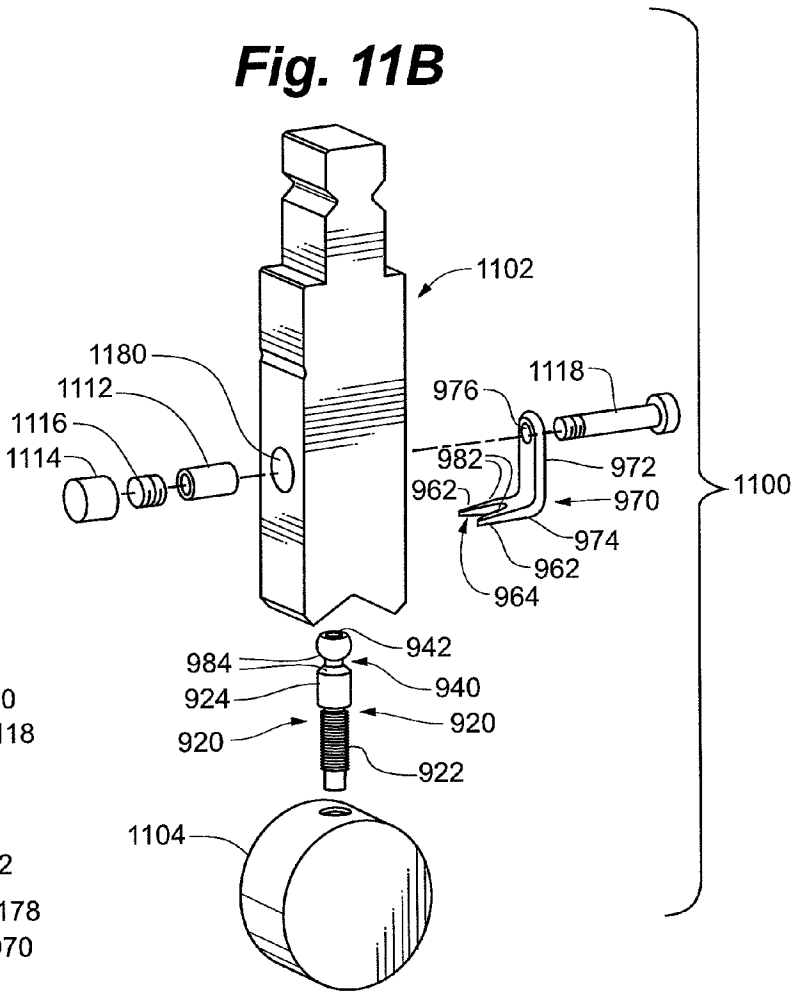
FIGS. 11A and 11B are cross-sectional and exploded assembly views, respectively, of another punch assembly having a coupling design involving an exemplary securing and release mechanism in accordance with certain embodiments of the invention, with FIG. 11A also showing a further enlarged view of a section of the assembly.
Figures 1, 11A:
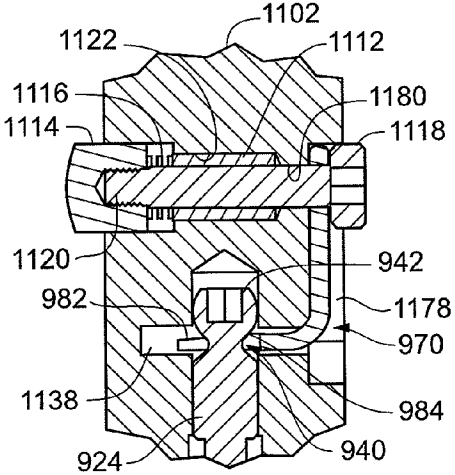
Figure 11A:
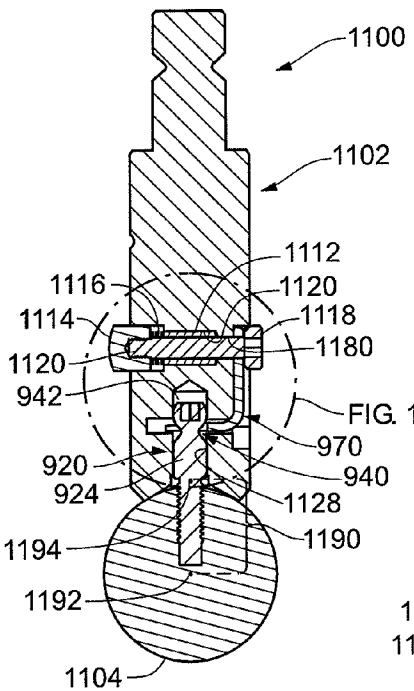

FIGS. 7 and 8 illustrate front cross-sectional and exploded assembly views of punch assemblies having coupling designs involving other exemplary fasteners in accordance with certain embodiments of the invention, while FIGS. 9-11 illustrate front cross-sectional and exploded assembly views of punch assemblies having coupling designs involving exemplary securing and release mechanisms. The punch assemblies of FIGS. 7-11 involve punch assemblies 700, 800, 900, 1000, and 1100, respectively. However, as described above, embodiments of the invention are equally applicable to die assemblies. While varying in style from the punch assembly 100 of FIG. 1, the punch assemblies 700, 800, 900, 1000, and 1100 generally share the same functional characteristics. In particular, the punch assemblies 700, 800, 900, 1000, and 1100 have punch tip holders 702, 802, 902, 1002, and 1102, respectively, that can be conjoined or separated as desired with respect to punch tips 704, 804, 904, 1004, and 1104, respectively.

Also similar to punch assembly 100, each of the punch assemblies 700, 800, 900, 1000, and 1100 incorporates self-seating structure involving a linking member for positioning and seating the punch tips on their corresponding holders. In many respects, these linking members share the same attributes of the linking member 120 already described. To that end, in certain embodiments, each of the linking members of FIGS. 7, 8, 9, 10, and 11 has a first end region (or portion) to enable coupling with a tip and a second end region (or portion) to enable coupling with a holder. Further, similar to the punch assembly 100 of FIG. 1 and the die assembly 300 of FIG. 3, in certain embodiments, the second end region includes a female detent, and engagement between an edge (or a surface) of the coupling means and an edge (or a surface) bounding the female detent retains a mount surface of the tip directly against a corresponding surface of the holder.

FIGS. 7A and 7B (at times collectively referenced herein as FIG. 7) and FIGS. 8A and 8B (at times collectively referenced herein as FIG. 8) illustrate coupling means involving exemplary coupling members (e.g., fasteners) 736 and 836, which respective punch tip holders 702 and 802 are adapted to receive (e.g., carry). As shown, in certain embodiments, the coupling members 736 and 836 are received in threaded openings (e.g., threaded bores) 738 and 838 respectively, of the holders 702 and 802. In such cases, the openings (or bores) 738 and 838 are generally oriented to intersect (i.e., open into) punch tip holder apertures (e.g. bores) 728 and 828, respectively.

The coupling member 736 of FIG. 7 involves a different type of set screw. In certain embodiments, as shown, the coupling member 736 has a leading end 760 defining a recess 762 that generally extends inward. As perhaps best shown in the enlarged view of FIG. 7A, the shape of the recess 762 is defined by its inner surfaces 764. Here, the recess 762 is shaped generally like a cone; however, the recess 762 can be defined as other shapes. The illustrated linking member 720 defines a female detent 740 at its second end region 724, and also has a ball-shaped head 742 at the leading end of such region 724. When the coupling member 736 is partially backed out in its corresponding opening 738, the coupling member's leading end 760 is in turn backed outward from the aperture 728 for the linking member 720, so as to permit the head 742 of the linking member 720 to be fully advanced in the aperture 728. Conversely, when the coupling member 736 is tightened, its leading end 760 is advanced into the aperture 728, wherein the linking member head 742 is received within the coupling member recess 764, with the head's (and the linking member's) position being retained through contact between the inner surfaces 764 of the recess 762 and outer surfaces 744 of the linking member's head 742.

In certain embodiments, as perhaps best seen in the enlarged view of FIG. 7A, the inner surfaces 764 of the recess 762 are ramped (or "angled") to mate with correspondingly-configured outer surfaces 744 of the head 742. In this case, the geometrical engagement of the coupling member's leading end 760 and the linking member's head 742 enables a tighter coupling. In particular, as the coupling member 736 is advanced in the illustrated threaded opening 738, the angled inner surfaces 766 defining the coupling member recess 762 engages the corresponding outer surfaces 744 of the linking member head 742. In further advancing the coupling member 736 in the opening 738, the head 742 of the linking member 720 advances further into the recess 762. Consequently, the inner angled surfaces 764 of the coupling member 736 cam with the outer surfaces 744 of the head 742, and in the process, further pulls the linking member's second end region 724 into its final, operatively-mounted position within the holder aperture 728. Such pulling (and in this case, raising) of the linking member 720 with the holder aperture 728 provides a tight coupling between punch tip 704 and punch tip holder 702, thereby providing a tightly-bound assembly without the need to perform a prior reference stroke of the press (for seating purposes).

The fastener 836 of FIG. 8 involves a coupling member 836 comprising a camming-type screw. In certain embodiments, as shown, the camming-type screw fastener 836 defines an opening 870 extending generally perpendicular through a leading end of the fastener 836. The linking member 820 is similar in structure to that described above with respect to linking member 720, having a ball-shaped head 842 at the leading end of its second end region 824. In one orientation of the camming screw, the opening 870 permits the head 842 of the linking member 820 to move axially relative to the camming screw. However, when the camming screw is rotated out of that orientation (as shown), an edge (or surface) 872 bounding the opening 870 bears against (and cams with) the head 842. In certain embodiments, as perhaps best shown in the enlarged view of FIG. 8A, the edge 872 is ball shaped to mate with the ball-shaped fastener head 842. As such, when the camming screw is rotated so as to retain the linking member 820 (as described above), the camming between the ball-shaped edge (or surface) 872 and the head 842 results in a pulling of the linking member's second end region 824 into its final, operatively-mounted position within the aperture 828. Such pulling of the linking member 820 within the aperture 828 provides a tight coupling between punch tip 804 and punch tip holder 802, thereby forming a tightly-bound assembly without the need to perform a prior reference stroke of the press (for seating purposes).

Like FIGS. 7 and 8, FIGS. 9A and 9B (at times collectively referenced herein as FIG. 9) illustrate a coupling means involving an exemplary coupling member 936 that the punch tip holder 902 is adapted to receive. As shown, in certain embodiments, the coupling member 936 comprises a screw received in a threaded opening (e.g., threaded bore) 980 of the holder 902. However, unlike the designs of FIGS. 7 and 8 (as well as the designs of FIGS. 1 and 3, which also exemplify screw coupling means), the screw is part of an assembly that projects into the punch tip holder aperture (e.g. bore) 928 for receiving the second end region 924 of the linking member 920. In certain embodiments, as shown, the fastener assembly includes a catch member 970, which is oriented to extend into aperture (bore) 928. As shown, in certain embodiments, the catch member 970 has a generally "L-shaped" configuration, e.g., so as to have opposing end regions perpendicular to each other. A first end region 972 of the illustrated catch member 970 is coupled to the illustrated screw 936; however, the catch member 970 can alternately be integrally formed with the screw. While an exemplary coupling is shown involving an eyelet 976 (defined in the catch member 970) through which the screw 936 extends, many other coupling mechanisms can be used.

As shown, the first end region 972 of the catch member 970 extends from the screw 936 along a channel 978 of the holder 902. The channel 978, in addition to fluidly communicating with (e.g., being open to) the opening 980 for the screw 936, communicates with a further opening (e.g., bore) 938 configured to receive the second end region 974 of the catch member 970 and to intersect (open into) the aperture (e.g., bore) 928 that receives the linking member 920. The linking member 920 can be similar in structure to that described above with respect to linking member 720, i.e., defining a female detent 940 at its second end region 924 and having a ball-shaped head 942 at the leading end of such region 924. The second end region 974 of the catch member 970, in certain embodiments, has a leading end 960 having spaced-apart legs 962 that define a generally v-shaped or u-shaped recess 964 there between.

As shown, the screw 936 is used as a driver of the catch member 970. When the illustrated screw 936 is partially backed outward in its corresponding opening 980, the second end region 974 of the catch member 970 can in turn be partially backed outward from the aperture 928 for the linking member 920, so as to permit the head 942 of the linking member 920 to pass between the legs 962 and through the recess 964. In turn, when the fastener 936 is tightened, the catch member 970 is anchored against the holder 902 such that the catch member's legs 962 are positioned in a lock position within the aperture 928 and extend into the detent 940, thereby retaining the head 942 in its operative position. In certain embodiments, as perhaps best shown in the enlarged view of FIG. 9A, the surfaces (e.g., camming surfaces) 982 of the legs 962 that engage the head 942 ramp (e.g., are angled) upward from their ends so as to cam with a corresponding outer surface 984 of the linking member head 942. As such, when the fastener 936 is tightened so as to mate the second end region 974 through the aperture 928, the camming action between the ramped leg surfaces 982 and the head outer surfaces 984 results in a pulling of the linking member to its operative position. Such pulling of the linking member 920 within the aperture 928 provides a tight coupling between punch tip 904 and punch tip holder 902, thereby forming a tightly-bound assembly without the need to perform a prior reference stroke of the press (for seating purposes).

As described above, FIGS. 10A and 10B (at times collectively referenced herein as FIG. 10) and FIGS. 11A and 11B (at times collectively referred herein as FIG. 11) illustrate coupling designs involving exemplary securing and release mechanisms. In certain embodiments, whether by mechanical, electrical, magnetic, hydraulic, and/or pneumatic means, such coupling design can involve an actuator to selectively trigger either securing or releasing of the linking member (and thereby, the corresponding punch tips 1004 or 1104) with respect to the punch tip holder 1002 or 1102, respectively.

As shown, the coupling means of FIGS. 10 and 11 are in some ways similar to the design of FIG. 9. For example, the same type of catch member 970 (as detailed above) and linking member 920 are provided. As such, these elements have the same reference numbers in FIGS. 10 and 11 as they do in FIG. 9. Thus, in certain embodiments, when the second end region 974 of the catch member 970 is advanced, camming between the ramped leg surfaces 982 of the catch member 970 and the outer surface(s) 984 of the linking member head 942 results in a pulling of the linking member to its operative position. Such pulling of the linking member 920 within the holder aperture provides a tight coupling between punch tips 1004 and 1104 and punch tip holders 1002 and 1102 in the designs of FIGS. 10 and 11, respectively (and without having to perform a reference stroke of the press for seating purposes in either case).

Further, like the design of FIG. 9, the punch tip holders 1002, 1102 are provided with similarly-configured channels 1078, 1178 and openings 1038, 1138 to respectively receive the first and second end regions 972, 974 of the catch member 970. Moreover, fastener members 1016, 1118 of FIGS. 10 and 11 serve as drivers of the catch member 970, and particularly, the second end region 974 of the catch member 970. However, instead of threadingly advancing and backing out the fastener members to secure and release the linking member 920, the assemblies of FIGS. 10 and 11 involve button and solenoid assemblies that are actuated to move the fastener members 1016, 1118, thereby triggering the release and securing operations, as described below.

One distinct aspect of the coupling designs of FIGS. 10 and 11 is the trigger for actuating movement of the catch member 970. Looking to the punch assembly 1000 of FIG. 10A, the actuator involves a button assembly. To that end, in certain embodiments, the assembly includes a mechanically-operated button 1012, a spring 1014, and a fastener member 1016. The assembly 1010, as shown, extends through an opening (e.g., bore) 1080 of the tip holder 1002. In constructing the assembly 1010, the fastener member 1016 is coupled to the first end region 972 of the catch member 970 (optionally via an eyelet 976 as exemplified above) and then advanced through the opening 1080 so as receive the spring 1014 and have its leading end 1018 coupled to a back end 1020 of the button 1012. In certain embodiments, as shown, the button back end 1020 can have a threaded aperture (e.g., bore) 1022 to threadably receive the leading end 1018 of the fastener member 1016; however, other manners of coupling can alternately be used.

In certain embodiments, when the button 1012 is actuated (e.g., by depressing the button 1012), the coupling means is brought to an "open state" (not shown), in which the linking member 920 (and thereby, the punch tip 1004) is released from (if previously held by) the punch tip holder 1002. The open state can also provide a period of time during which the linking member second end region 924 can be selectively adjoined to or removed from the punch tip holder 1002. Such "open state" is not shown, however, from what was already detailed with reference to FIG. 9, the open state results when the second end region 974 of the catch member 970 is backed out from the aperture 1028 so as to allow free advancement and removal of the linking member 920 within aperture (or bore) 1028. Perhaps as best shown in the enlarged view of FIG. 10, actuation of the button 1012 forces the fastener member 1016 outward from the opening 1080, which thereby also forces the catch member 970 to back out from the aperture 1028. It should be appreciated that as actuated, the button 1012 is adverse to (i.e., is overcoming) a biasing force of the spring 1014, e.g., due to the button 1012 being in a depressed position.

In certain embodiments, as shown, when the linking member 970 is fully advanced in the punch tip holder aperture 1028 during the "open state" of the coupling means, the button 1012 can be released (e.g., via a further depression of the button, or by simply releasing the button), whereby the coupling means is brought into a "closed state." Thus, in contrast to the "open state," the "closed state" involves the second end region 974 of the catch member 970 extending inwardly through the aperture 1028 so as to retain the linking member 920 in aperture (or bore) 1028. Regarding the button assembly 1010, in certain embodiments, a channel 1024 is provided in, and coaxial with, the opening 1080 for seating the spring 1014 therein. The channel 1024 as shown opens toward the button 1012 such that the spring 1014 can bias the button 1012. Thus, the spring 1014 forces the button 1012 to extend outward from opening 1080, which as a result pulls the fastening member 1016 inwardly with respect to the opening 1080. Consequently, the catch member 970 is held in position, thereby securing the linking member 920 (and thereby, the punch tip 1004) to the punch tip holder 1002.

Regarding the punch assembly 1000 of FIG. 10, while not shown, it should be appreciated that the button 1012 can be electrically powered, and in certain designs, can involve a switch. Given the design of the button assembly 1010, it should be appreciated that a one-step process can be used for releasing the linking member 920 (and thereby, the corresponding punch tip 1004) with respect to the punch tip holder 1002. In certain embodiments, the one-step process involves only a single-motion process. For example, once the linking member 920 is secured in the aperture (e.g., bore) 1028 of the holder 1002, by actuating the button 1012 (e.g., via a single-motion, one step process of depressing the button 1012), the catch member 970 (via the fastening member 1016) is automatically drawn outward from the holder aperture 1028 so as to unlock the linking member 1020 from the holder 1002. A two-step process can be performed for securing the linking member 920, i.e., seating the punch tip 1004 in relation to the punch tip holder 1104 (via insertion of the linking member(s) 920 in the corresponding aperture(s) 1028), and releasing the button 1012 to secure the linking member(s) 920 (and thereby, the punch tip 1004) to the punch tip holder 1002. It should be appreciated that the steps of these processes can advantageously be performed without having to use secondary tools.

Thus, in certain embodiments, the coupling design of the punch assembly uses an actuator to trigger either securing or releasing of the linking member (and thereby, the punch tip) with respect to the punch tip holder. While the punch assembly 1000 of FIG. 10 uses a button assembly, the actuator for the punch assembly 1100 of FIG. 11 is a solenoid assembly. The designs of the FIGS. 10 and 11 are similar, except for the addition of a solenoid 1112 within opening (or bore) 1180 for the solenoid assembly 1110 and the replacement of the button 1012 with a cap 1114. As shown, in certain embodiments, the assembly 1110 further includes the cap 1114, a spring 1116, and a fastener member 1118. The solenoid assembly 1110, in certain embodiments, is constructed similar to the button assembly 1010 of FIG. 10, except that the solenoid 1112 is provided, and the cap 1114 (replacing the button 1012 of FIG. 10) is coupled to the leading end 1120 of the fastener member 1118. As shown, in certain embodiments, the solenoid 1110 is seated in a channel 1122 (or bore region) that is coaxial with the opening 1180 and opens toward the spring 1116 and cap 1114. In certain embodiments, when actuated (so as to bring the coupling means to an "open state"), the solenoid 1112 is configured to force the fastener member 1118 outward with respect to the opening 1080, which thereby also forces the extension 970 to back out from the aperture 1128, thereby releasing the linking member 920 (and thereby, the punch tip 1104) from the punch tip holder 1102. Conversely, when the solenoid is deactivated (bringing the coupling means to a "closed state"), the solenoid 1112 releases the fastener member 1118. As a result, the spring 1116 biases the cap 1114 so as to advance partially outward from the opening 1180, which pulls the fastening member 1118 inwardly with respect to the opening 1180. Consequently, the catch member 970 (coupled to the fastener member 1118) is locked in position, thereby securing the linking member 920 (and thereby, the punch tip 1104) to the punch tip holder 1102.

While not shown, the solenoid 1112 generally involves an external source for its activation, whether being pneumatic, hydraulic, or electromagnetic in design. Further, given the design of the solenoid assembly 1110, it should be appreciated that a one-step process of actuating the solenoid can be used for releasing the linking member 920 (and thereby, the corresponding punch tip 1104) with respect to the punch tip holder 1102. In certain embodiments, the one-step process involves only a single-motion process. For example, in cases in which such actuation is triggered via a button or switch, the single-motion, one-step process involves depressing/flipping such button/switch to deactivate the solenoid. In contrast, a three-step process can be used for securing the linking member 920 (and thereby, the punch tip 1104) to the punch tip holder 1102. Such steps involve actuating the solenoid 1120 to open the aperture(s) 1028 of the holder 1102, inserting the linking member 920 in the aperture(s) (e.g., bore) 1028 of the holder 1002, and deactivating the solenoid (e.g., via depressing/flipping a button/switch) so as to secure the linking member(s) 920 within the aperture(s) 1028 of the holder 1002. It should be appreciated that each step of both processes can be performed without the use of secondary tools.

While the designs of FIGS. 10 and 11 are described above with regard to "open" states of the coupling means being associated with actuating the triggering means (button 1012 or solenoid 1112), it should be appreciated that the designs could just as well be modified to function in the alternative as well. That is, by actuating the triggering means, the coupling means can be brought into a "closed state."

Figure 12B:
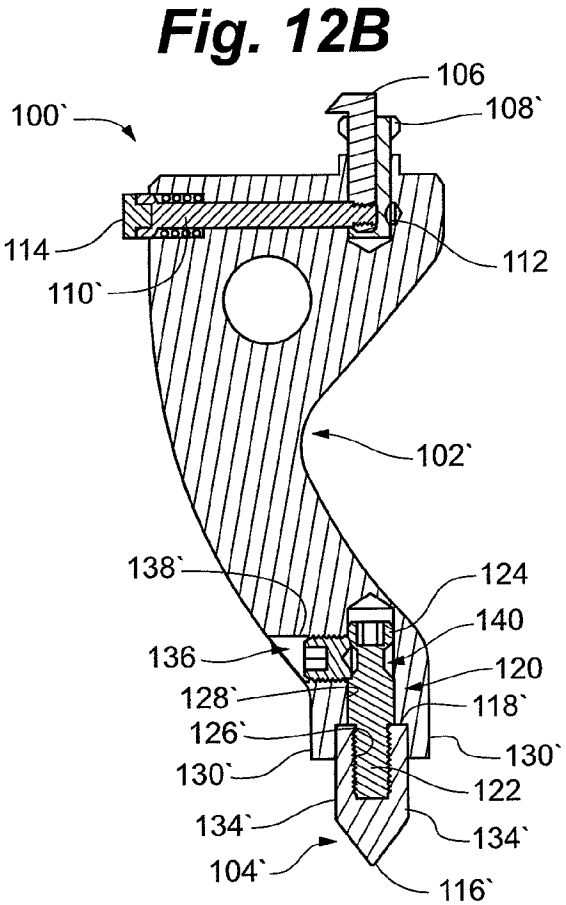
FIGS. 12A, 12B, and 12C are front, cross-sectional, and exploded assembly views, respectively, of a further punch assembly in accordance with certain embodiments of the invention.
Figure 12A:
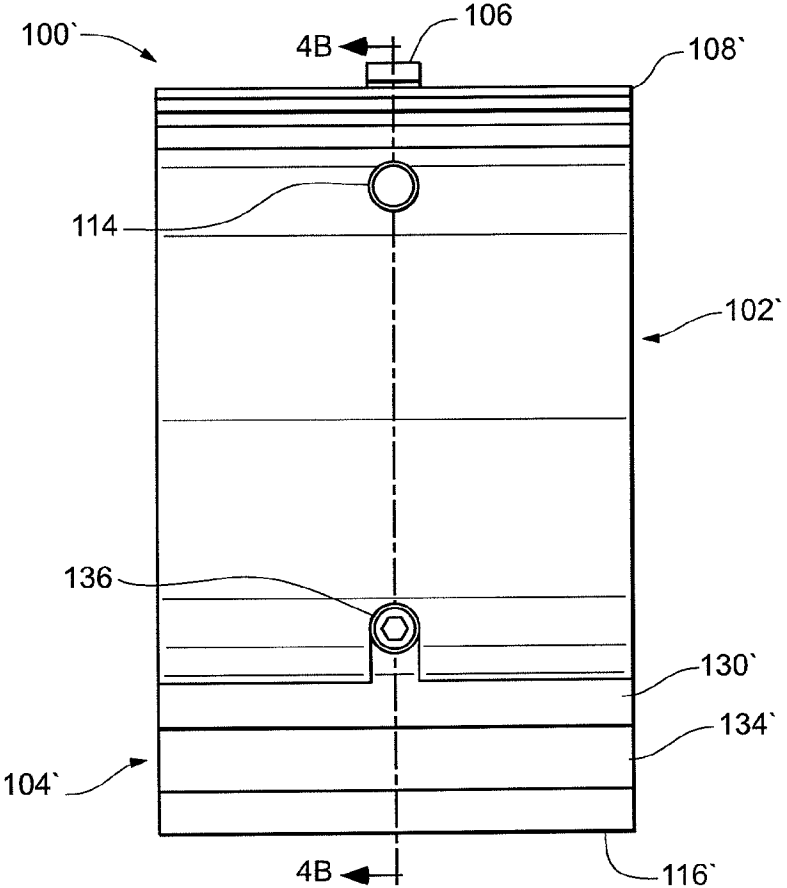
Figure 12C:
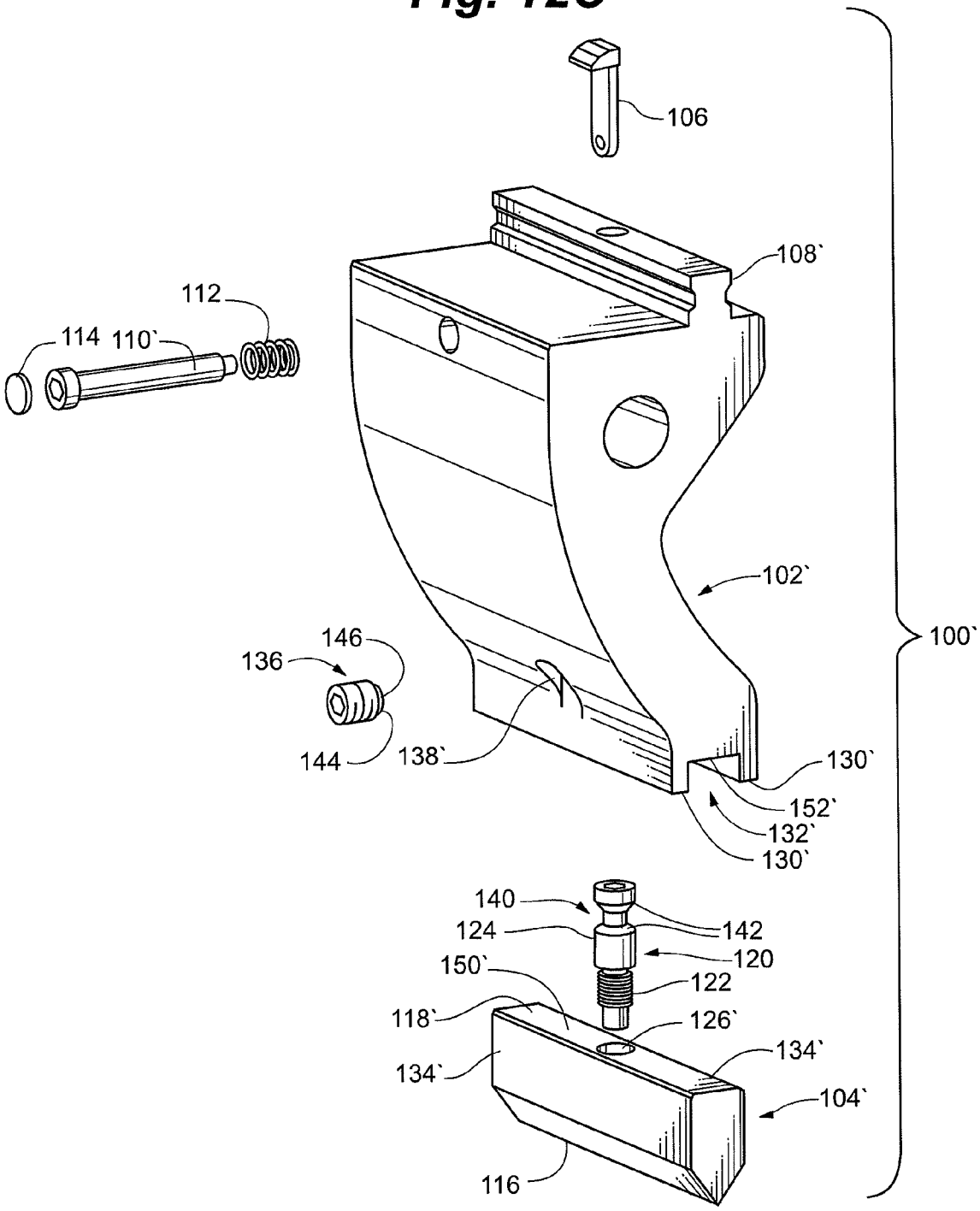

FIGS. 12A, 12B, and 12C (at times collectively referenced herein as FIG. 12) illustrate front, cross-sectional, and exploded assembly views, respectively, of a further punch assembly 100' in accordance with certain embodiments of the invention. In many respects, the punch assembly 100' shares the same structure and attributes already described with respect to the punch assembly 100 of FIG. 1. For example, the punch assembly 100' includes a punch tip holder 102' and punch tip 104' that are configured to be adjoined (e.g., connected rigidly to each other) or separated as desired. However, the punch tip 104' is a different configuration than the punch tip 104 of punch assembly 100. In particular, the first end 116' of the tip 104' defines a workpiece-deforming surface configured for making a different bend angle than the punch tip 104 of punch assembly 100. As shown, this difference in the configuration of the tip end 116' enables the size of the punch tip 104' to be decreased, which in turn can affect the size and shape of the corresponding holder 102'. Regardless of these differences between the punch assemblies 100 and 100', it should be appreciated that the self-seating structure (e.g., fastening body 120, rails 130', and the mounting channel) are just as applicable in these other tooling design types.

FIG. 12 is representative of a group of embodiments wherein the coupling member is configured to move selectively toward or away from the linking member in response to rotation of the coupling member. FIGS. 1, 3, 7, 8, and 12 are other examples. Here, rotation of the coupling member in a first direction (e.g., clockwise) causes the coupling member to move (e.g., axially) toward the linking member, whereas rotation of the coupling member in a second direction (e.g., counterclockwise) causes the coupling member to move (e.g., axially) away from the linking member.

The rounded design of the tool tips 704, 804, 904, 1004, and 1104 of FIGS. 7, 8, 9, 10, and 11, respectively, do not allow the mated tip holder surfaces to be uniformly perpendicular to the pressing axis. Accordingly, even with the use of the self-seating structure, uniform force distribution may not be entirely possible. However, even with such designs, by positioning the self seating structure (e.g., the linking member 120*a*, 120*b*, 120*c*, or 102*d*) to extend between the confronting tip holder surfaces enables fairly good distribution through the tool assemblies 700, 800, 900, 1000, and 1100. In addition, by incorporating the self-seating structure, these assemblies still realize other of the favorable aspects, including simplified assembly/disassembly, enhanced structural integrity, and reduced wear.

Further, as opposed to tool assemblies having generally planar mounting surfaces, tool assemblies adapted to receive rounded tool tips (with their different sizes and radii) present other challenges which the linking members have been found to address. For example, with reference to the punch assembly 1100 as shown in FIG. 11A, as the radius of the punch tip 1104 increases, the distance 1190 between the center point 1192 of the punch tip 1104 and the apex 1194 of the punch tip holder 1102 increases. Consequently, the linking member 920 backs out of the holder aperture 1128. Accordingly, the linking member 920 can be sized accordingly so that its detent 940 still intersects with the extrusion second end 974. This involves a simple process of changing out the linking member 920. However, if the linking member 920 were associated with varying coupling hardware, the hardware would also require changing out. Such hardware could invariably include springs, retaining bars, nuts, etc. However, with the linking member of the invention not having (i.e., equipped with) any corresponding hardware, the linking member serves as a more efficient (in terms of cost) and effective (in terms of ease of change out) solution.

Having now described embodiments concerning tool assembly designs with self-seating structure, further reference is made to the separable portions of these assemblies, e.g., the tool tip holder 102 and the tool tip 104 of FIG. 1, and the materials used in forming these portions. As described above, the separable portions of such assemblies have been formed of different materials over the years. To that end, while the punch tips and die inserts (or "die plates") preferably are formed of high-end hardened materials, such as tool-steel, other hardened materials have been substituted over the years for the punch holders and die bodies to provide a strong, yet less expensive, option. One of these substitute materials has involved aluminum. Besides the cost savings, other benefits in using aluminum for the punch holders and die bodies involve attaining a lighter design and the still being able to achieve a fairly good material hardness.

Applicants have discovered that the punch holders and/or die bodies can be formed, e.g., by molding, casting, or extruding, using a variety of non-ferrous materials, with these materials being light-weight, less costly than tool steel, and having fairly good hardness properties. For example, in certain embodiments, aluminum (or another aircraft metal) can be formed for the punch holders and die bodies so as to have tensile strength at least about 80 ksi, and perhaps more preferably, in the range of between about 80 ksi and about 100 ksi, which generally correspond to hardness values nearly reaching the lower range for tool steel. Other light-weight materials that exhibit suitable hardness properties include titanium and carbon fiber composites. In one group of embodiments, the holder of the tool assembly comprises, consists essentially of, or consists of a metal (e.g., an aircraft metal) selected from the group consisting of beryllium, titanium, magnesium, aluminum and alloys comprising one or more of these metals. Preferably, the tip (whether being a punch tip or a die insert) comprises, consists essentially of, or consists of steel. In addition, the holders and bodies, once formed, can be coated or heat treated to reduce their wear and increase their surface strength. For example, the coating process can involve any one of anodizing, induction, or nitriding treatment, each of which is known in the art. Furthermore, the punch tips and die inserts can also be coated to reduce their wear and increase their lubricity. For example, the coating process can involve any one of laser, induction, or nitriding treatment, each of which is known in the art. For particular reference, e.g., regarding nitriding, the disclosure of U.S. Pat. No. 4,790,888 is noted, the entire teachings of which are incorporated herein by reference.

With reference to the above, in certain embodiments, the punch tip holders and/or die inserts can be formed of a single integral body with regard to such materials. However, in certain embodiments, the holders and tips (e.g., along their extents aligning with a pressing axis) can involve separately portions formed together. For example, the ends of such holders and tips are often found to encounter the greatest forces and stresses. Thus, in certain embodiments, one or more of the upper or lower ends of the holders and inserts can be formed of hardened materials, while the reminder of the holders and inserts are formed of the materials exemplified above (e.g., being light-weight, less costly than tool steel, and having fairly good hardness properties). This same principle can be further applicable to the punch tips and/or die bodies. For example, in certain embodiments, the working ends of the punch tips and/or die bodies can be formed of hardened materials, with the reminder of the holders and inserts being formed of the materials exemplified above (e.g., being light-weight, less costly than tool steel, and having fairly good hardness properties).

While preferred embodiments of the present invention have been described, it is to be understood that numerous changes, adaptations, and modifications can be made to the preferred embodiments without departing from the spirit of the invention and the scope of the claims. Thus, the invention has been described in connection with specific embodiments for purposes of illustration. The scope of the invention is described in the claims, which are set forth below.

What is claimed is:

1. A tool assembly configured for being mounted on a tool holder of a press, the tool assembly comprising separable portions, the separable portions including a holder and a tip, the tool assembly including self-seating structure configured to position and seat a first of the holder and the tip in relation to a second of the holder and the tip, the self-seating structure including a linking member having first and second end regions, the first end region received within an aperture of the first of the holder and tip, the second end region extending from the first end region and thereby protruding from the aperture of the first of the holder and tip, the second end region configured for receipt within an aperture of the second of the holder and tip such that the linking member is concealed within the apertures, and a mount surface of the first of the holder and tip is positioned against a corresponding surface of the second of the holder and tip.

2. The tool assembly of claim 1 wherein the first end region of the linking member forms a rigid attachment with the first of the holder and tip and the second end region of the linking member is configured to be selectively adjoined to or removed from the second of the holder and tip.

3. The tool assembly of claim 2 wherein the first of the holder and tip is a tip, and wherein the second of the holder and tip is a holder.

4. The tool assembly of claim 1 wherein the tip is formed of a first material and the holder is formed of a second material that is lighter than the first material.

5. The tool assembly of claim 4 wherein the second material comprises non ferrous, non-steel material.

6. The tool assembly of claim 5 wherein the second material comprises aluminum having a material strength of at least approximately 80 ksi.

7. The tool assembly of claim 2 wherein the holder comprises a plurality of like modular segments that are aligned to form a longitudinal extent of the holder, wherein the tip comprises a single body of the same longitudinal extent, and wherein a plurality of linking members are spaced along the single body, each of the plurality corresponding to an aperture defined in one of the modular holder segments.

8. The tool assembly of claim 7 wherein the modular segments are conjoined in an end-to-end fashion so as to form the longitudinal extent of the holder.

9. The tool assembly of claim 2 wherein the second of the holder and tip has means for operatively coupling the first of the holder and tip to the second of the holder and tip in a seated position.

10. The tool assembly of claim 9 wherein the coupling means is adjustably engaged with the linking member so as to operatively couple the holder and the tip, the coupling means being adjustable in relation to a segment of the linking member.

11. The tool assembly of claim 10 wherein the coupling means is configured to be actuated, via a one-step process, so as to release the linking member.

12. The tool assembly of claim 11 wherein the one-step process is a tool-less operation.

13. The tool assembly of claim 12 wherein the one-step process involves only a single-finger motion.

14. The tool assembly of claim 12 wherein the coupling means comprises a button assembly.

15. The tool assembly of claim 12 wherein the coupling means comprises a solenoid assembly.

16. The tool assembly of claim 10 wherein the segment comprises a female detent, and engagement between an edge or a surface of the coupling means and an edge or a surface bounding the female detent retains a mount surface of the tip directly against a corresponding surface of the holder.

17. The tool assembly of claim 3 wherein the self-seating structure further comprises one or more rails protruding from the holder, the one or more rails and the linking member providing a two-fold means of positioning the tip and the holder in relation to each other.

18. The tool assembly of claim 1 wherein a coupling member is joined to the second of the holder and tip, at least a portion of the coupling member being movable selectively toward or away from a segment of the linking member, wherein when the segment is received in the aperture of the second of the holder and tip, movement of the coupling means portion toward said segment allows causes said portion of the coupling member to bear against said segment so as to force the second end region of the linking member deeper into the aperture of the second of the holder and tip, and thereby seat the tip on the holder, and wherein such movement of the coupling means portion away from said segment allows the linking member to be released from the aperture of the second of the holder and tip.

19. The tool assembly of claim 18 wherein the aperture of the second of the holder and tip extends in a direction at least substantially parallel to a pressing axis of the tool assembly, and said movement of the coupling means toward or away from said segment of the linking member is in a direction crosswise to the tool assembly's pressing axis.

20. The tool assembly of claim 19 wherein said crosswise direction to the tool assembly's pressing axis is at least substantially perpendicular to the tool assembly's pressing axis.

21. The tool assembly of claim 18 wherein said portion of the coupling member is configured to cam with said segment of the linking member so as to seat the tip on the holder without having to perform a reference stroke of the press for seating purposes.

22. The tool assembly of claim 21 wherein the tool assembly is provided in combination with the press, the tool assembly being mounted on a beam of the press, and wherein said camming causes the tip to move toward the beam into a seated position on the holder.

23. The tool assembly of claim 1 wherein the tool assembly is provided in combination with the press, wherein the press comprises a press brake and the holder is mounted on a beam of the press brake.

24. A tool assembly configured for being mounted on a tool holder of a press, the tool assembly comprising separable portions, the separable portions including a holder and a tip, the tool assembly including self-seating structure configured to position and seat the tip in relation to the holder, the self-seating structure comprising a linking member having first and second end regions, the first end region received within an aperture of the tip, the second end region protruding from the aperture of the tip and being configured for receipt within an aperture of the holder such that a mount surface of the tip is positioned against a corresponding surface of the holder, the holder receiving a coupling member that is adjustably movable relative to the linking member so as to engage the member and thereby operatively seat the tip to the holder.

25. The tool assembly of claim 24 wherein the tip comprises a punch tip and the holder comprises a punch tip holder.

26. The tool assembly of claim 24 wherein the tip is formed of a first material and the holder is formed of a second material that is lighter than the first material.

27. The tool assembly of claim 24 wherein the coupling member is part of a coupling assembly comprising an actuator, wherein release of the segment of the linking member is a one-step process.

28. The tool assembly of claim 27 wherein the one-step process is a tool-less operation.

29. The tool assembly of claim 24 wherein the coupling member is adjustable in relation to a segment of the linking member, wherein the segment comprises a female detent, and engagement between an edge of the coupling member and an edge of the female detent retains the mount surface of the tip directly against the corresponding surface of the holder.

30. A method of providing a tool assembly for use on a tool holder of a press having a pressing axis, the tool assembly comprising separable portions, the separable portions including a holder and a tip, the tool assembly including self-seating structure configured to position and seat a first of the holder and the tip in relation to a second of the holder and the tip, the self-seating structure including a linking member having first and second end regions, the second end region extending from the first end region, the method comprising the steps of:

attaching the first end region of the linking member to the first of the holder and tip, whereby the first end region of the linking member is received within an aperture of the first of the holder and tip while the second end region of the linking member protrudes from the aperture;

inserting the second end region of the linking member within an aperture of the second of the holder and tip such that the linking member is concealed within the apertures, and a mount surface of the first of the holder and tip is positioned against a corresponding surface of the holder; and operatively coupling the first of the holder and tip to the second of the holder and tip by engaging the linking member with a coupling member of the second of the holder and tip, wherein such engagement results in seating of the first of the holder and tip to the second of the holder and tip.

31. The method of claim 30 wherein the linking member is attached to the first of the holder and tip such that an axis of the linking member is substantially parallel to the pressing axis, the mount surface of the tip and the corresponding surface of the holder being substantially perpendicular to the pressing axis.

32. The method of claim 30 wherein the coupling member is received within an opening of the second of the holder and tip and is selectively movable in the opening toward or away from the second end region of the linking member when received in the aperture of the second of the holder and tip, wherein movement of the coupling member toward the linking member results in engagement and camming of the coupling member with the linking member, thereby coupling the tip to the holder in a seated position.

33. The method of claim 32 wherein said operative coupling of the tip to the holder involves actuating the coupling member via a tool-less operation.

34. The method of claim 33 wherein the tool-less operation involves pressing a button of a button assembly.

35. The tool assembly of claim 1, wherein the holder has a tool shank on an end thereof, and the tip is coupled to the holder at an opposing end of the holder.

36. The tool assembly of claim 24, wherein the holder has a tool shank on an end thereof, and wherein the tip is coupled to the holder at an opposing end of the holder.

* * * * *